US012588730B2

(12) United States Patent
Chen et al.

(10) Patent No.: US 12,588,730 B2
(45) Date of Patent: Mar. 31, 2026

(54) ARTICLES OF FOOTWEAR INCLUDING AN INTEGRATED POCKET

(71) Applicant: NIKE, Inc., Beaverton, OR (US)

(72) Inventors: Yuchung K. Chen, Portland, OR (US); Neil Crumbleholme, Lake Oswego, OR (US); Roberto De Marchi, Treviso (IT); Tetsuya T. Minami, Portland, OR (US); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 116 days.

(21) Appl. No.: 18/168,288

(22) Filed: Feb. 13, 2023

(65) Prior Publication Data

US 2023/0255304 A1 Aug. 17, 2023

Related U.S. Application Data

(60) Provisional application No. 63/310,389, filed on Feb. 15, 2022.

(51) Int. Cl.
*A43B 3/00* (2022.01)
*A43B 23/02* (2006.01)

(52) U.S. Cl.
CPC ..... *A43B 3/0031* (2013.01); *A43B 23/0245* (2013.01)

(58) Field of Classification Search
CPC ..... A43B 3/0031; A43B 3/34
(Continued)

(56) References Cited

U.S. PATENT DOCUMENTS 4,280,287 A * 7/1981 Gulbransen ..... A43B 3/0031 36/114
4,697,363 A * 10/1987 Gamm ..... A43B 23/025 36/114

(Continued)

FOREIGN PATENT DOCUMENTS

GB 2110521 A 6/1983

OTHER PUBLICATIONS

Dec. 14, 2021, KangaROOS Womens Speedleague Mesh Workout Running Shoes, listed on website «https://www.bhfo.com/products/kanagaroos-womens-speedleague-mesh-workout-running-shoes?variant=41809815339178», 2 pages.

(Continued)

*Primary Examiner* — Alissa L Hoey
*Assistant Examiner* — Akwokwo Olabisi Redhead
(74) *Attorney, Agent, or Firm* — Banner & Witcoff, Ltd.

(57) ABSTRACT

Uppers for articles of footwear include an integrated pocket, e.g., accessible from the outside of the upper and/or article of footwear. In at least some examples, the pocket may be formed solely from structural components of the footwear upper, i.e., structural components provided in the upper for purposes other than to form the pocket. As some more specific examples, the footwear upper components forming the pocket may extend beyond the interior chamber of the pocket by at least 25 mm (and in some examples, at least 40 mm, at least 50 mm, at least 75 mm, or even at least 100 mm) in any direction (e.g., forward, rearward, upward, and/or downward from the pocket's interior chamber). The pocket may house an electronic module, such as one or more sensors for measuring features of an athlete's performance.

20 Claims, 14 Drawing Sheets

(58) Field of Classification Search
USPC ..... 36/136, 164, 165
See application file for complete search history.

(56) References Cited

U.S. PATENT DOCUMENTS

| | | | | |
|---|---|---|---|---|
| 4,852,276 | A * | 8/1989 | Savoca | A43B 3/0078 40/636 |
| 5,623,772 | A * | 4/1997 | Sunderland | A43B 3/0031 36/2.6 |
| 5,640,786 | A | 6/1997 | Buyayez | |
| 5,894,686 | A * | 4/1999 | Parker | A43B 3/44 36/137 |
| 6,094,844 | A | 8/2000 | Potts | |
| 6,115,948 | A | 9/2000 | Mitchell | |
| 6,513,381 | B2 | 2/2003 | Fyfe et al. | |
| 7,596,891 | B2 | 10/2009 | Carnes et al. | |
| 7,632,239 | B2 | 12/2009 | Dar et al. | |
| 7,866,066 | B2 | 1/2011 | Forbes | |
| 8,028,443 | B2 | 10/2011 | Case, Jr. | |
| 8,857,078 | B2 | 10/2014 | Berner, Jr. et al. | |
| 8,935,860 | B2 | 1/2015 | Torres | |
| 8,956,228 | B2 | 2/2015 | Shum et al. | |
| 9,625,485 | B2 | 4/2017 | Oleson et al. | |
| 9,642,415 | B2 | 5/2017 | Pease et al. | |
| 9,734,304 | B2 | 8/2017 | Blackadar et al. | |
| 10,277,963 | B2 | 4/2019 | Case, Jr. | |
| 10,455,887 | B2 | 10/2019 | London | |
| 10,820,656 | B2 | 11/2020 | Bonifas et al. | |
| 10,918,162 | B2 | 2/2021 | Cook et al. | |
| 10,959,481 | B2 | 3/2021 | Gruben et al. | |
| 11,047,706 | B2 | 6/2021 | Kong et al. | |
| 11,076,655 | B2 | 8/2021 | Beers et al. | |
| 11,083,240 | B2 | 8/2021 | Veracini | |
| 11,109,635 | B2 | 9/2021 | Molyneux et al. | |
| 11,186,930 | B2 | 11/2021 | Huffa et al. | |
| 2007/0011919 | A1* | 1/2007 | Case | A61B 5/6807 36/132 |
| 2015/0272290 | A1* | 10/2015 | Baum | A45F 5/00 224/217 |
| 2017/0354348 | A1 | 12/2017 | Winter | |
| 2022/0132993 | A1* | 5/2022 | Breitholz | A43B 23/28 36/136 |
| 2023/0148708 | A1* | 5/2023 | Kohatsu | A43B 3/242 36/45 |

OTHER PUBLICATIONS

Apr. 14, 2021, Johnson, Nine best running pods 2021—tracking fitness through your feet, Gadgets & Wearables, website «https://gadgetsandwearables/2021/04/14/best-running-pods/», 13 pages.
Dec. 14, 2021, Nathan Sensor Pocket, REI Co-Op, listed on website, «https://www.rei.com/product/785888/nathan-sensor-pocket», 2 pages.
Jun. 1, 2023 (WO) International Search Report and Written Opinion—App PCT/US2023/062456, 10 pages.

* cited by examiner

ARTICLES OF FOOTWEAR INCLUDING AN INTEGRATED POCKET

RELATED APPLICATION DATA

This application is a U.S. Non-Provisional Application based on and claiming priority to U.S. Provisional Patent Appln. No. 63/310,389 filed Feb. 15, 2022 and entitled "Articles of Footwear Including an Integrated Pocket." U.S. Provisional Patent Appln. No. 63/310,389 is entirely incorporated herein by reference.

FIELD OF THE INVENTION

The present invention relates to articles of footwear and uppers for articles of footwear that include an integrated pocket. The integrated pocket may be configured to hold an electronic module, e.g., for measuring data relevant to athletic performance metrics.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces), and the upper also may include a heel counter to limit or control movement of the heel.

SUMMARY

This Summary is provided to introduce some general concepts relating to this technology in a simplified form that are further described below in the Detailed Description. This Summary is not intended to identify key features or essential features of the invention.

Aspects of this technology relate to uppers for articles of footwear, articles of footwear including the uppers, methods of making the uppers, methods of making articles of footwear including the uppers, and/or methods of using the uppers and/or articles of footwear, wherein the uppers include an integrated pocket. In at least some examples, the pocket may be accessible from the outside of the upper and/or article of footwear. In at least some examples, the pocket may be formed solely from structural components of the footwear upper, i.e., structural components provided in the upper for purposes other than to form the pocket. As some more specific examples, the footwear upper components forming the pocket may extend beyond the interior chamber of the pocket by at least 25 mm (and in some examples, at least 40 mm, at least 50 mm, at least 75 mm, or even at least 100 mm) in one or more directions (e.g., forward, rearward, upward, and/or downward from the pocket's interior chamber). The pocket may be formed without sewn seams, in at least some examples. The pocket may house an electronic module, such as one or more sensors for measuring features of an athlete's performance (e.g., movement speed; movement distance; kick speed, velocity, and/or power; ball touches; playing time; etc.).

BRIEF DESCRIPTION OF THE DRAWINGS

The following Detailed Description will be better understood when considered in conjunction with the accompanying drawings in which like reference numerals refer to the same or similar elements in all of the various views in which that reference number appears.

DETAILED DESCRIPTION

Figure 1:
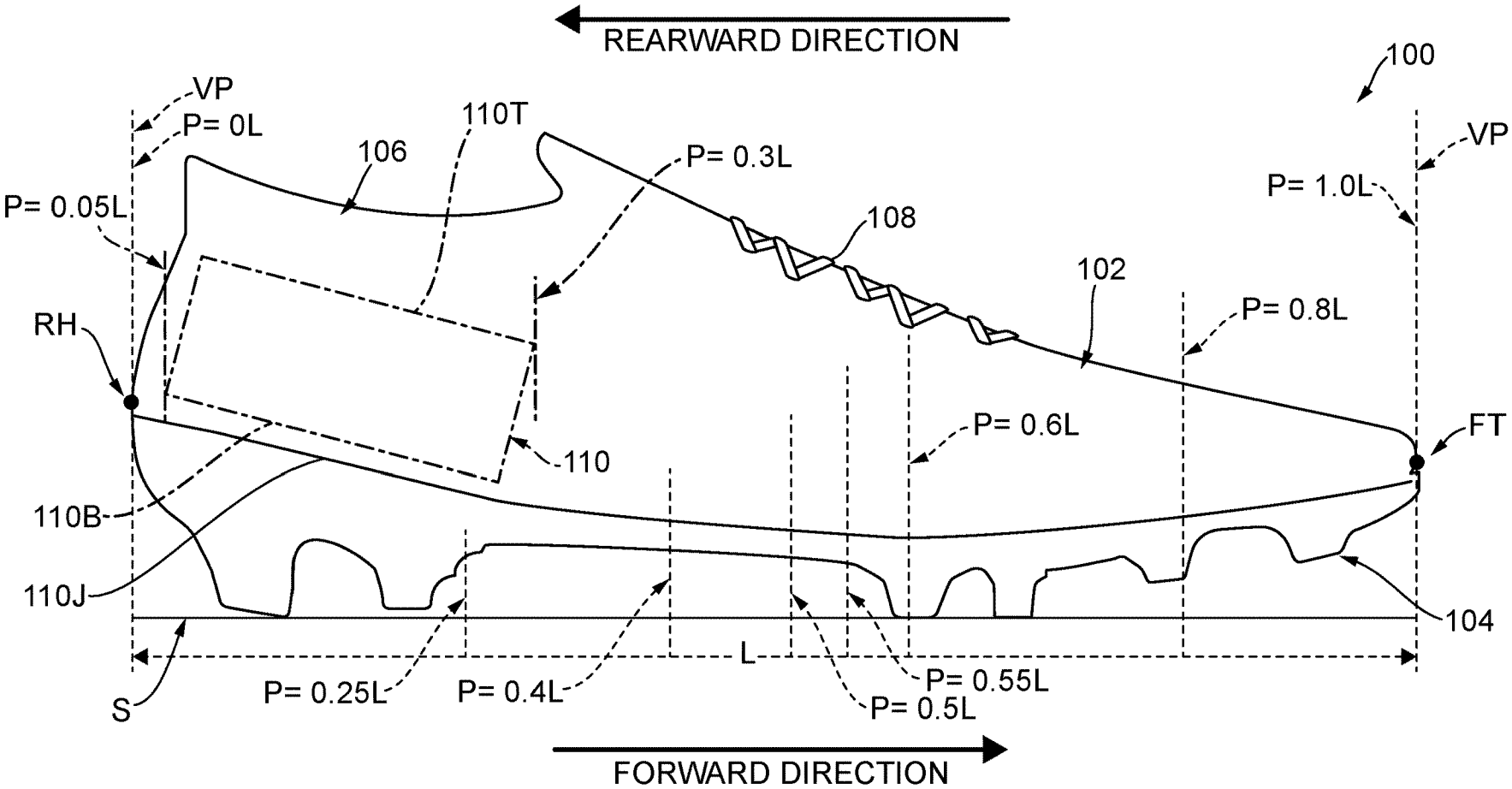
FIG. 1 shows general features of uppers and/or articles of footwear in accordance with aspects of this technology and provides some terminology and/or definitional information relating to this application.

In the following description of various examples of footwear structures and components according to the present disclosure, reference is made to the accompanying drawings, which form a part hereof, and in which are shown by way of illustration various example structures and environments in which aspects of this technology may be practiced. It is to be understood that other structures and environments may be utilized and that structural and functional modifications may be made to the specifically described structures, functions, and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, urban dance shoes, etc.), and the like.

Various structures and parameters of articles of footwear and uppers thereof are described based on a "longitudinal length" parameter L. Note FIG. 1. The longitudinal length L can be found with the article of footwear 100 oriented on a horizontal support surface S on its ground-facing surface (on its sole structure) in an unloaded condition (e.g., with no weight applied to it other than weight of other components of the article of footwear 100). Once so oriented, parallel vertical planes VP that are perpendicular to the horizontal support surface S are oriented to contact the rearmost heel (RH) location(s) and the forwardmost toe (FT) location(s) of the article of footwear 100 (or the upper, or the sole structure, or another component of interest). The parallel vertical planes VP should be oriented facing one another, e.g., extending into and out of the page of FIG. 1, and as far away from one another as possible while still in contact with the rearmost heel RH and forwardmost toe FT locations. The direct distance between these vertical planes VPs corresponds to the longitudinal length L of the article of footwear 100 (or the upper, or the sole structure, or another component of interest). The locations of various footwear components are described in this specification based on their respective locations along the longitudinal length L as measured forward from the rear heel vertical plane VP. The rearmost heel location(s) is (are) located at position 0 L and the forwardmost toe location(s) is (are) located at position 1 L along the longitudinal length L. Intermediate locations along the longitudinal length L are referred to by fractional locations (e.g., 0.25 L) along the longitudinal length L measured forward from the rear heel vertical plane VP. The term "parallel planes" as used herein are planes oriented parallel to the vertical planes VP. These parallel planes may intersect the longitudinal length L or longitudinal direction somewhere between P=0 L and P=1.0 L. Note FIG. 1, including example parallel plane location designators at 0.25 L, 0.4 L, 0.5 L, 0.55 L, 0.6 L, and 0.8 L.

The term "rearward" as used herein means at or toward the heel region of the article of footwear (or component thereof), and the term "forward" as used herein means at or toward a forefoot or forward toe region of the article of footwear (or component thereof). Unless otherwise defined, the terms "heel" or "heel region" refer to a region bounded by parallel planes at 0 L and 0.3 L, the term "midfoot" or "arch" refers to a region bounded by parallel planes at 0.3 L and 0.6 L, and the term "forefoot" refers to a region bounded by parallel planes at 0.6 L and 1.0 L. Also, the term "lateral" means the "little toe" side or outside edge of an article of footwear or component thereof (e.g., an upper, a sole structure, etc.), and the term "medial" means the "big toe" side or inside edge of an article of footwear or component thereof (e.g., an upper, a sole structure, etc.).

This application and/or its claims use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "third" in the specification may correspond to any numerical adjective used for that component or feature in the claims).

I. GENERAL DESCRIPTION OF ASPECTS OF THIS TECHNOLOGY

As noted above, articles of footwear, footwear uppers, and methods in accordance with aspects of this technology include forming the footwear upper to include an integrated pocket, e.g., accessible from the outside of the upper and/or article of footwear. This pocket may be formed solely from structural components of the footwear upper, i.e., structural components provided in the upper for purposes other than to form the pocket. In some examples, one or more components forming the pocket and/or one or more of the interior surfaces of the pocket will extend beyond the heel region of the upper, e.g., into the midfoot region of the upper, into the forefoot region of the upper, to the rear heel seam of the upper, to the forward toe area of the upper, into an instep region of the upper, forming and/or supporting a lace-engaging component of the upper, etc. Additionally or alternatively, one or more components forming the pocket and/or one or more of the interior surfaces of the pocket will extend beyond the perimeter of the pocket's interior area, e.g., to the top edge of the foot-receiving opening of the upper, to the junction between the upper and the sole structure, etc. Additionally or alternatively, in some specific examples of this technology: (i) one footwear upper component forming the pocket may have one major surface exposed in the interior of the pocket structure (forming at least a portion of an interior wall of the pocket) and its opposite major surface exposed in the foot-receiving chamber of the footwear (directly exposed to the wearer's foot in the interior of the footwear) and/or (ii) one footwear upper component forming the pocket may have one major surface exposed in the interior of the pocket structure (forming at least a portion of an exterior wall of the pocket) and its opposite major surface exposed at the exterior surface of the footwear (directly exposed to the external environment). In at least some examples of this technology, if component parts forming the pocket were removed from the upper, the upper would be missing at least one essential structural part (e.g., at least a portion of a sidewall of the upper would be missing, in some instances exposing the wearer's foot) such that the remaining upper components would not provide the structural features and/or integrity needed for the footwear's intended use.

Some aspects of this technology relate to uppers for articles of footwear and articles of footwear including the uppers, wherein the uppers include: (a) a first upper component having a first inward facing surface (facing the shoe interior) and a first outward facing surface (facing the external environment); and (b) a second upper component having a second inward facing surface and a second outward facing surface, wherein a portion of the second inward facing surface is fixed with a portion of the first outward facing surface. The first upper component and the second upper component define a pocket that includes: (a) the first outward facing surface, (b) the second inward facing surface, (c) a slit extending through the second upper component from the second outward facing surface to the second inward facing surface, and (d) an unfixed space between the first outward facing surface and the second inward facing surface where the second inward facing surface is unfixed with the first outward facing surface. The slit provides access to the unfixed space. In some examples, the pocket may consist of or consist essentially of the first upper component and the second upper component bonded together to form an outer perimeter of the unfixed space. The outer perimeter or outer boundary of the unfixed space of the pocket may be defined by an attached perimeter where the second inward facing surface is attached to the first outward facing surface. In at least some examples, 100% of this attached perimeter is formed in a "sewn seam-free manner" (e.g., by adhesive bonding, welding techniques, adhesive-free bonding, etc., without any sewing or stitching). The pocket may be located completely within the heel region of the upper and/or article of footwear. The upper may be engaged with a sole structure to form an article of footwear.

Additional aspects of this technology relate to methods of forming footwear uppers and/or articles of footwear (e.g., the types described above) that include: (a) providing a first upper component having a first surface and a second surface opposite the first surface; (b) forming a slit in a second upper component, the second upper component having a third surface and a fourth surface opposite the third surface, the slit extending from the third surface to the fourth surface; (c) arranging the first upper component and the second upper component such that the second surface directly faces the third surface; (d) creating a pocket forming arrangement between the second surface and the third surface (e.g., by placing at least a first portion of an adhesion-inhibiting component between the second surface and the third surface adjacent the slit, by removing adhesive or adhesive precursor from the portion of the second surface and/or the third surface, by not applying adhesive or adhesive precursor to a portion of the second surface and/or the third surface, by placing a three-dimensional blank between the second surface and the third surface, etc.); and (e) applying heat and/or pressure to bond the first upper component to the second upper component at locations around the pocket forming arrangement (e.g., the adhesion-inhibiting component) to define a pocket as unfixed space between the second surface and the third surface, the unfixed space forming due to the presence of the pocket forming arrangement (e.g., the adhesion-inhibiting component). The slit provides access to the unfixed space and an opening to the pocket. In some examples, the pocket as formed will consist of or consist essentially of the first upper component and the second upper component bonded together to form an outer perimeter of the unfixed space. The outer perimeter or outer boundary of the unfixed space of the pocket as formed may be defined by an attached perimeter where the inward facing surface is attached to the outward facing surface. In at least some examples, 100% of the attached perimeter will be formed in a sewn seam-free manner (e.g., by adhesive bonding, by welding techniques, by adhesive-free bonding, etc., without any sewing or stitching). Alternatively, sewing or stitching could be used to attach the first upper component and the second upper component together around the pocket perimeter. The pocket may be formed completely within the heel region of the upper and/or article of footwear. The methods further may include engaging the upper with a sole structure to form an article of footwear.

Still additional aspects of this technology relate to uppers and/or articles of footwear in which an electronic module is included in the pocket. The electronic module may include various types of electronic devices, such as: a speed and/or distance monitor, an accelerometer sensor, a pedometer, a display device, a light emitting device, etc. The electronic module may be battery powered such that no electrical wiring or electronic connectors are present in, present at, or extend through the pocket. Still additional aspects of this technology relate to use of uppers and/or articles of footwear including such integrated pockets, e.g., to house an electronic module, to receive data relating to athletic performance metrics relating to the wearer's use of the article of footwear, etc. As some more specific examples, aspects of this technology may be used to form a sensor-receiving pocket in football cleats (e.g., American football or soccer), and that sensor may be used to record data relating to a player's performance on the field and/or pitch.

Given the general description of features, examples, aspects, structures, processes, and arrangements according to certain examples of this technology provided above, a more detailed description of specific example footwear uppers, articles of footwear, and/or methods in accordance with this technology follows.

II. DETAILED DESCRIPTION OF EXAMPLE ARTICLES OF FOOTWEAR, FOOTWEAR UPPERS, AND OTHER COMPONENTS/FEATURES ACCORDING TO ASPECTS OF THIS TECHNOLOGY

Referring to the figures and following discussion, various examples of footwear uppers, articles of footwear, and methods in accordance with aspects of this technology are described.

In addition to illustrating features of terminology used in this application as discussed above, FIG. 1 generally illustrates features of a lateral side of an article of footwear 100 in accordance with at least some aspects of this technology. Such articles of footwear 100 include a footwear upper 102 formed from one or more component parts. The footwear upper 102 may be made from one or more conventional parts and/or made in conventional manners. While other options are possible, the illustrated footwear upper 102 is formed from multiple components (e.g., one or more fabric components, one or more knit components, one or more thermoplastic elastomer components, one or more thermoplastic polyurethane components, one or more "skin" components, etc.) that are engaged together by sewn seams, by melt bonds, by welding techniques, by mechanical connectors, etc. In at least some examples of this technology (and as will be described in more detail below), at least some of the footwear upper components will be joined together by heat and pressing techniques, e.g., such as the techniques described in U.S. Pat. No. 9,723,895 B2, which patent is entirely incorporated herein by reference.

FIG. 1 further shows the footwear upper 102 engaged with a sole structure 104. The sole structure 104, which may include one or more component parts, may have any desired construction and/or component parts and/or may be engaged with the footwear upper base 102 in any desired manner, including conventional constructions and/or conventional component parts and/or conventional engagement methods as are known and used in the footwear arts. The sole structure 104 of this illustrated example is a cleated sole structure (e.g., including soccer or football cleats), but other desired types of sole structures and/or traction element constructions and/or arrangements may be used in other examples of this technology.

The upper 102 defines a foot-receiving opening 106 that provides access to an interior foot-receiving chamber defined at least in part by the upper 102 (and optionally, at least in part by the sole structure 104). A securing system (e.g., lace 108, but any other type of securing system (e.g., strap systems, hook-and-loop fasteners, buckles, etc.) also may be used) is provided to secure the article of footwear 100 to a wearer's foot.

FIG. 1 also includes a dash-dot box illustrating a general region 110 in which an integrated pocket in accordance with at least some aspects of the present technology may be located. In at least some examples of this technology, the entire pocket (e.g., the entire interior chamber of the pocket) will be located within general region 110. General region 110 may have: (a) its rearward end located at a parallel plane provided at P=0.05 L, and (b) its forward end located at a parallel plane provided at P=0.3 L. Thus, in some examples, the pocket (e.g., the entire pocket) may be located between parallel planes a P=0.05 L and P=0.3 L. Additionally or alternatively, the general region 110 may have: (a) at least a portion of its top edge 110T located within 20 mm (and in some examples, within 15 mm, within 12 mm, or even within 8 mm) of the foot-receiving opening 106 and/or (b) at least a portion of its bottom edge 110B located within 20 mm (and in some examples, within 15 mm, within 12 mm, or even within 8 mm) of the junction 110J between the upper 102 and the sole structure 104. Top edge 110T and bottom edge 110B of general region 110 may correspond to locations of the top perimeter edge 200TE and the bottom perimeter edge 200BE, respectively, of the interior chamber 200A of the pocket 200, as will be described in more detail below, e.g., in conjunction with FIGS. 2I-4 and 5C-6A. Additionally or alternatively, in some examples of this technology, the entire general region 110 and the entire pocket (e.g., the entire interior chamber of the pocket) will be located within the heel region of the upper 102 and/or within the heel region of the article of footwear 100. Additional example details and features of the location of the pocket will be described in more detail below.

Figure 2A:
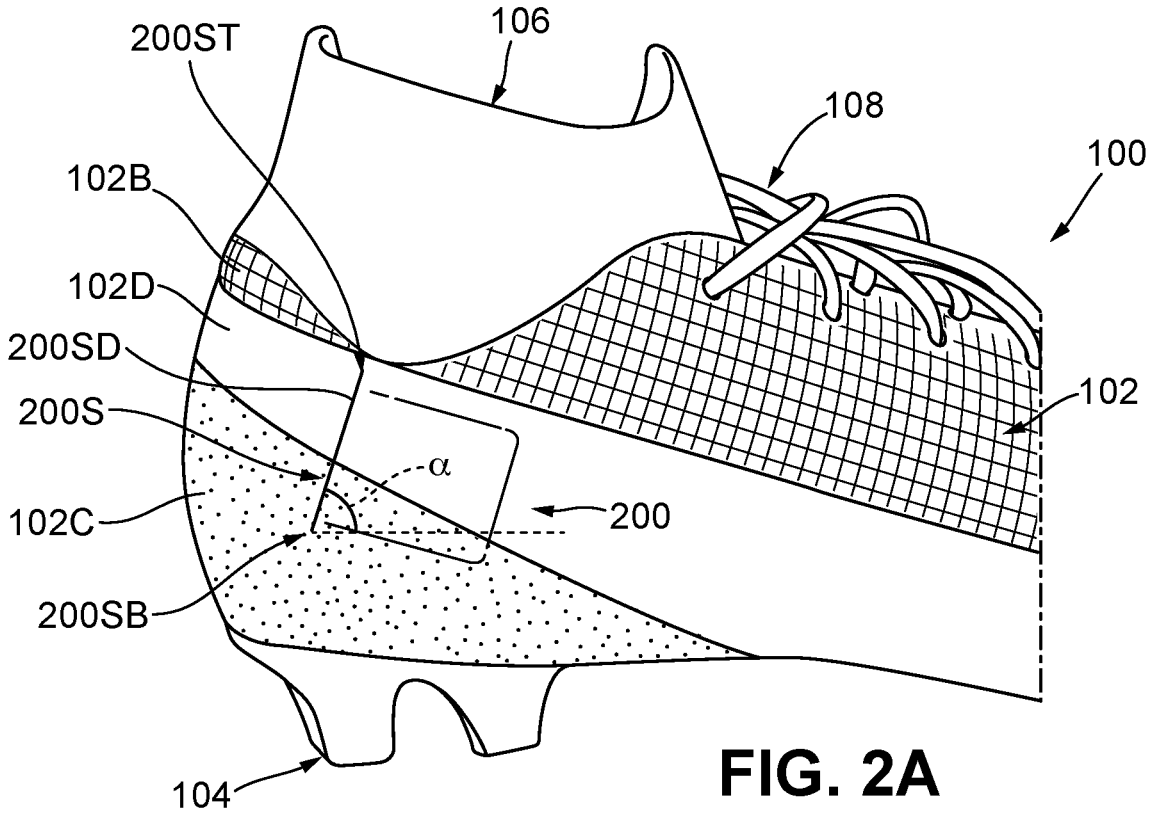
FIGS. 2A-2J provide various views of articles of footwear, uppers, and pockets in accordance with aspects of this technology.
Figure 2B:
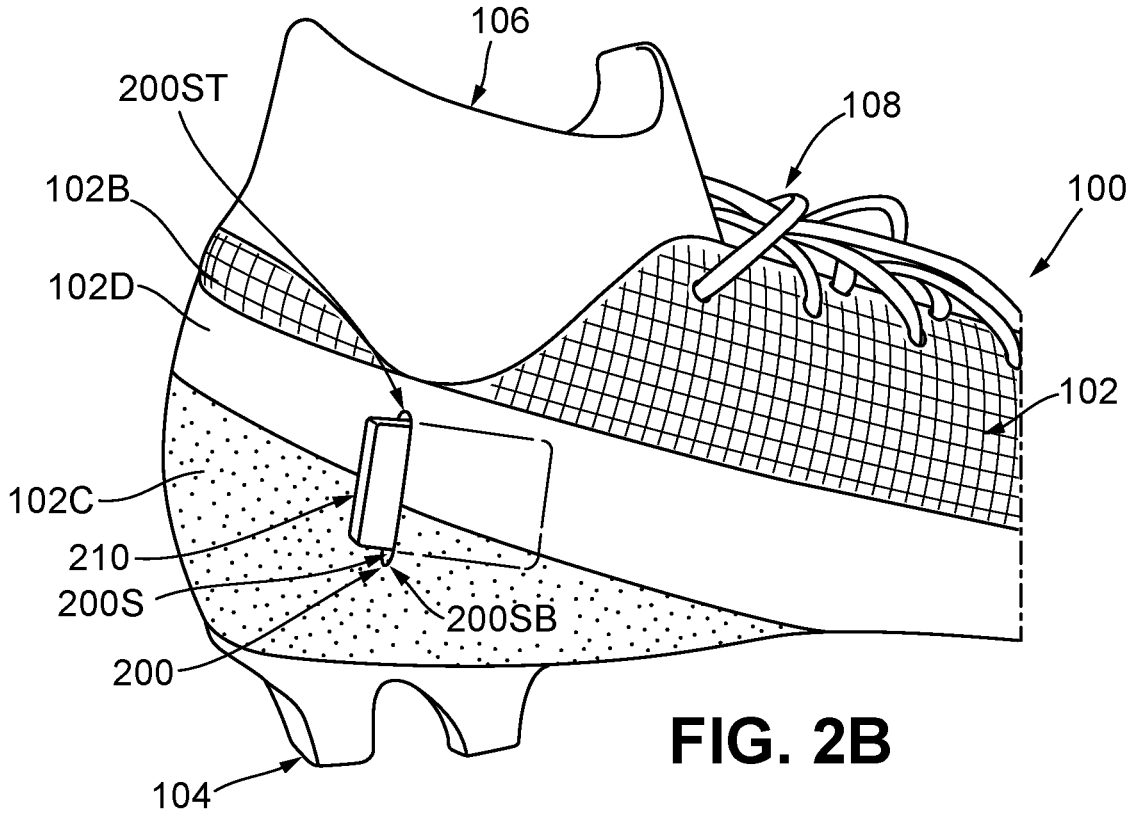
Figure 2C:
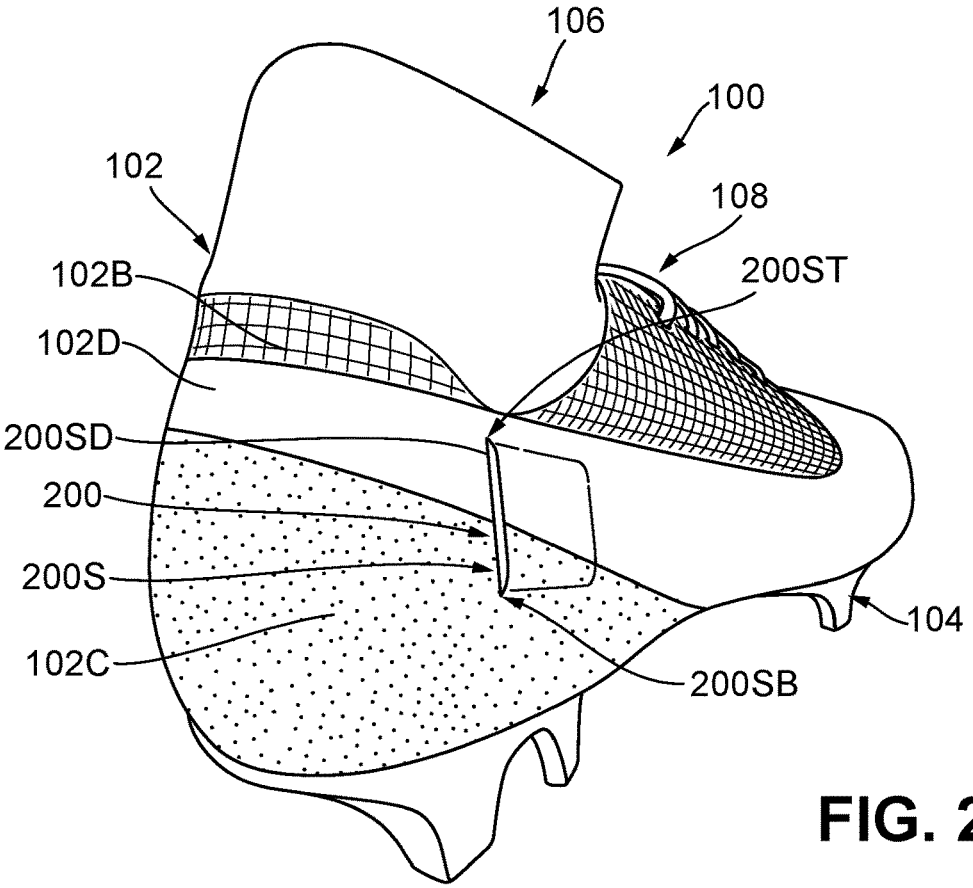
Figure 2D:
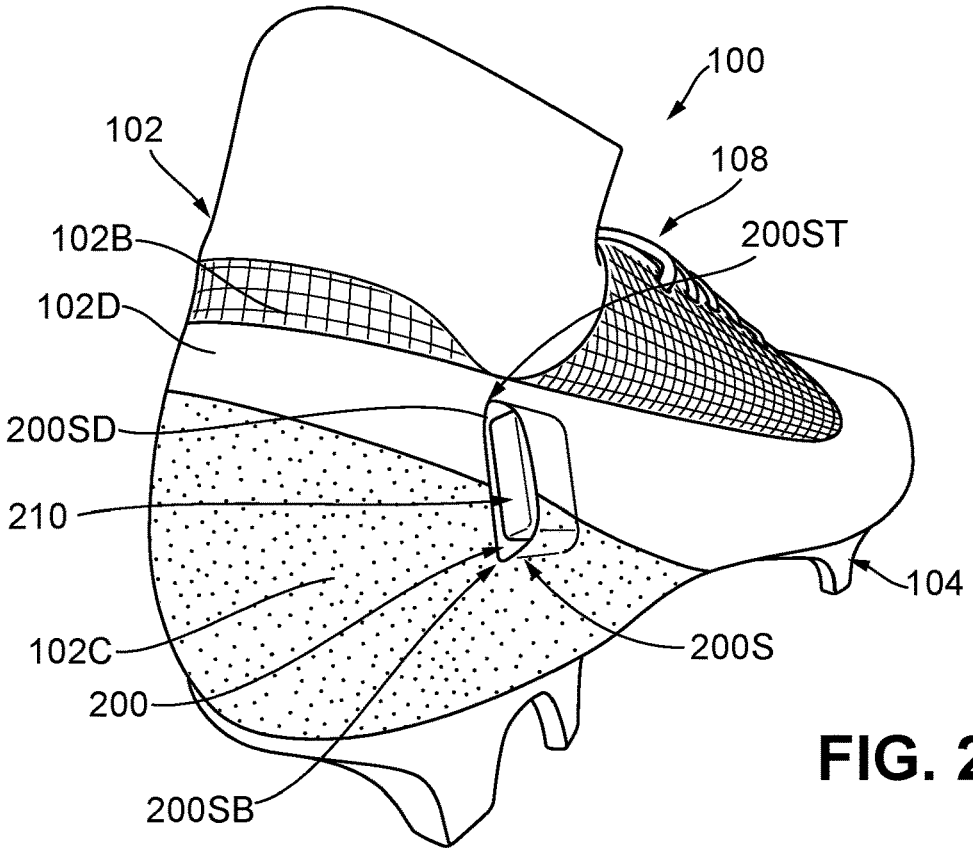
Figure 2E:
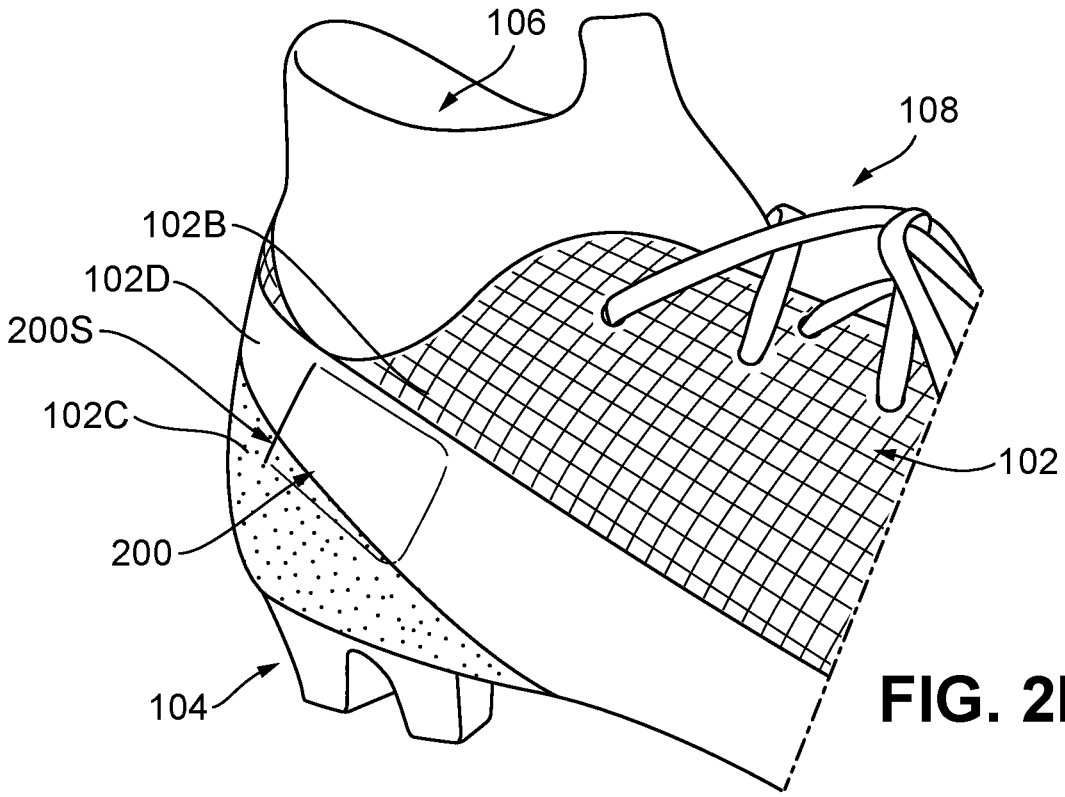
Figure 2F:
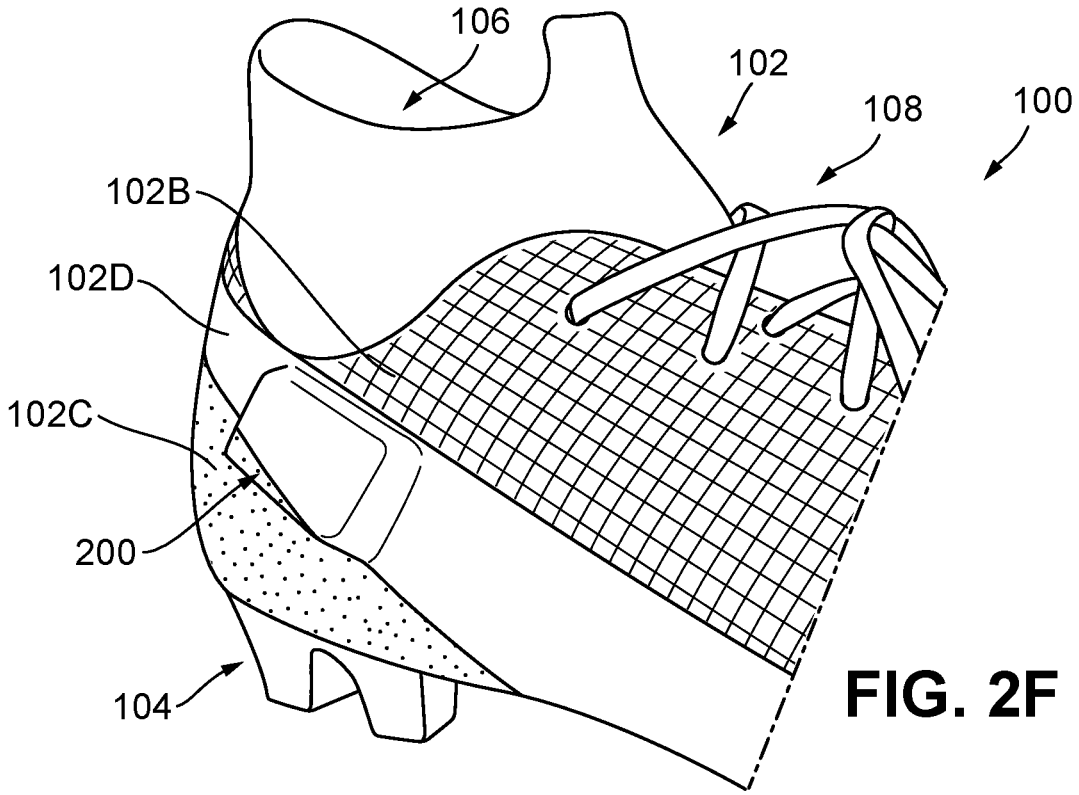
Figure 2G:
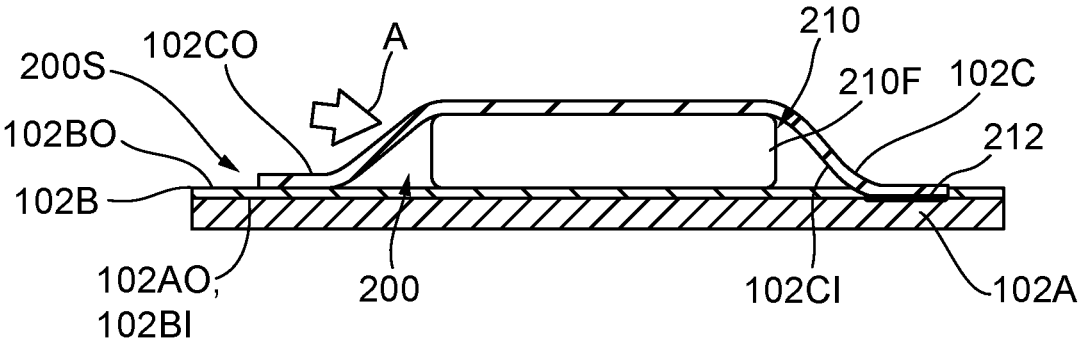
Figure 2H:
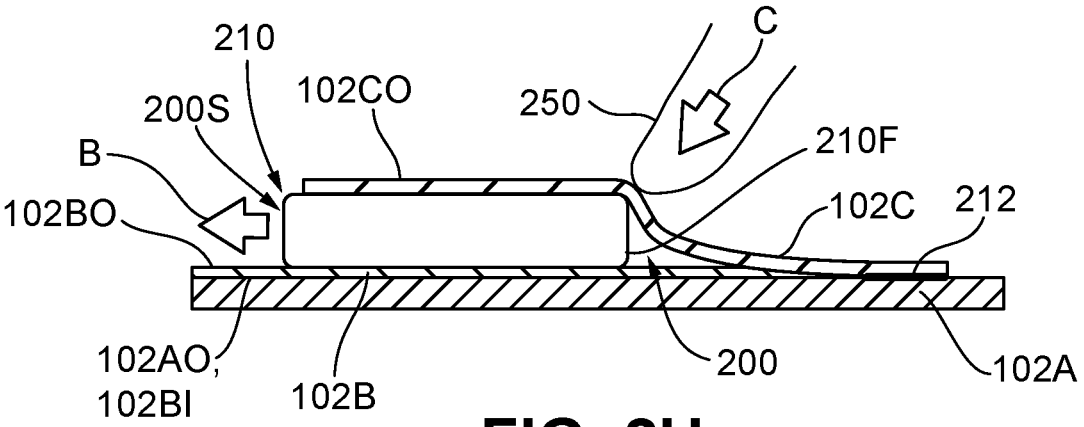
Figure 2I:
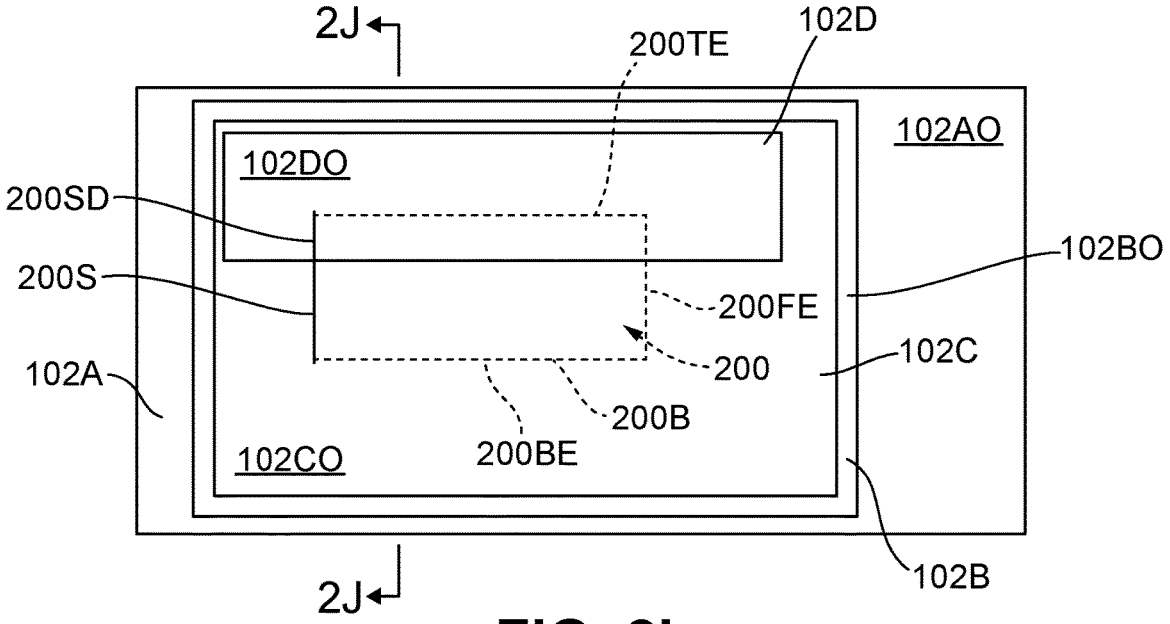
Figure 2J:
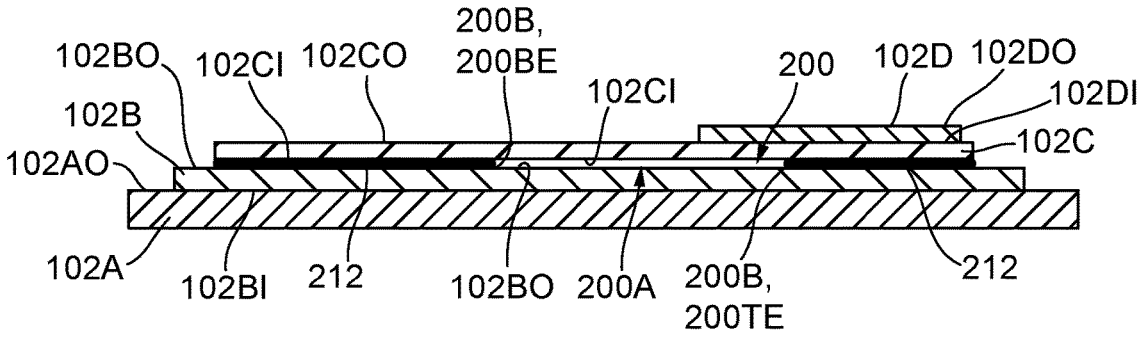

FIGS. 2A-2J show various views of a rearward portion of an article of footwear 100 including an integrally formed pocket 200 in accordance with some examples of this technology. Where the same reference numbers are used in FIGS. 2A-2J as used in FIG. 1, the same or similar parts are being referenced, and much of the corresponding description may be omitted. FIGS. 2A, 2C, and 2E show lateral side, lateral rear perspective, and lateral forward perspective views, respectfully, of article of footwear 100 and its pocket 200. FIGS. 2B, 2D, and 2F provide similar views to FIGS. 2A, 2C, and 2E, respectively, but an electronic module 210 is at least partially inserted into the pocket 200. The electronic module 210 may include any desired type of electronic device, such as: a speed and/or distance monitor, an accelerometer sensor, a pedometer, a display device, a light emitting device, etc. FIG. 2G provides a view of the closed pocket 200 with the electronic module 210 inserted therein, and FIG. 2H provides a view showing removal of the electronic module 210 from the pocket 200. FIG. 2I provides an enlarged "face-on" view of the pocket 200 area of the upper 102, and FIG. 2J provides a cross-sectional view along line 2J-2J of FIG. 2I.

The pocket 200 of this illustrated example is formed as part of the upper 102 for the article of footwear 100 and directly from structural component parts of the upper 102. The upper 102 may include a base upper component 102A, which may comprise a knit material, another fabric material, a mesh material, a lining material, a foam material, or another upper material, including upper materials conventionally known and used in the footwear art. The pocket 200 is formed from: (a) a first upper component 102B having a first inward facing surface 102BI and a first outward facing surface 102BO; and (b) a second upper component 102C having a second inward facing surface 102CI and a second outward facing surface 102CO. Second outward facing surface 102CO of this example forms an exposed exterior surface of the footwear upper 102. The inward facing surface 102BI of the first upper component 102B may be fixed to (e.g., bonded to, such as by an adhesive or hot melt bond) the outward facing surface 102AO of the base upper component 102A. Further, a portion of the second inward facing surface 102CI of the second upper component 102C is fixed with (e.g., bonded to, such as by an adhesive or hot melt bond) a portion of the first outward facing surface 102BO of the first upper component 102B. The bond between the first upper component 102B and the second upper component 102C is shown as elements 212 in FIG. 2J. The first upper component 102B and/or the second upper component 102C may constitute "skin" layers of the types described in U.S. Pat. No. 9,723,895 B2, and the pocket 200 may be formed between portions of these "skin" layers. All three upper components 102A, 102B, and 102C may be fixed together in a single heat and pressing step, e.g., using processes described in U.S. Pat. No. 9,723,895 B2. Alternatively, in some examples of this technology: (a) the base upper component 102A could be omitted (in at least some areas of the upper 102) such that the first inward facing surface 102BI of the first upper component 102B forms an interior-most surface of at least a portion of the upper 102 (e.g., exposed in the foot-receiving chamber of the upper) or (b) the first upper component 102B could be omitted and the pocket 200 may be formed between the outward facing surface 102AO of the base upper component 102A and the inward facing surface 102CI of the second upper component 102C.

By selectively bonding portions of the second inward facing surface 102CI of the second upper component 102C with the first outward facing surface 102BO of the first upper component 102B, the first upper component 102B and the second upper component 102C define the pocket 200. More specifically, the pocket 200 is formed by: (a) the first outward facing surface 102BO of the first upper component 102B, (b) the second inward facing surface 102CI of the second upper component 102C, and (c) an unfixed space 200A located between the first outward facing surface 102BO and the second inward facing surface 102CI where the second inward facing surface 102CI is unfixed with the first outward facing surface 102BO (e.g., due to the absence of an adhesive or lack of adhesion at the location of the unfixed space 200A). The boundary 200B between (a) the bonded locations of the second inward facing surface 102CI with the first outward facing surface 102BO and (b) the unfixed space 200A is shown by broken lines in FIG. 2I. A slit 200S extending through the second upper component 102C from the second outward facing surface 102CO to the second inward facing surface 102CI provides access to the unfixed space 200A and to the pocket 200. The unfixed space 200A extends forward from the slit 200S in this illustrated example, and the slit 200S is located in a lateral rear heel location of the upper 102. As further shown in FIGS. 2A-2F, the slit 200S is exposed at an exterior surface of the upper 102 in all configurations of the upper 102 (e.g., whether the pocket 200 is filled or unfilled). No flap or closure system is present in this example pocket 200. If necessary or desired, however, the edge of the slit 200S may be finished and/or reinforced, e.g., to prevent undesired tearing, fraying, stretching, etc.

In this illustrated example pocket 200, the outer boundary 200B of the unfixed space 200A of the pocket 200 is defined by an attached perimeter where the second inward facing surface 102CI is attached to the first outward facing surface 102BO. In at least some examples of this technology, 100% of this attached perimeter is formed in a sewn seam-free manner (i.e., without sewing or stitching to form the attached perimeter and/or boundary 200B of the pocket 200). More specifically, the outer boundary 200B of the unfixed space 200A of the pocket 200 in this illustrated example includes: (i) a top edge 200TE where the first outward facing surface 102BO is bonded to the second inward facing surface 102CI, (ii) a bottom edge 200BE where the first outward facing surface 102BO is bonded to the second inward facing surface 102CI, and (iii) a forward edge 200FE where the first outward facing surface 102BO is bonded to the second inward facing surface 102CI, wherein the forward edge 200FE extends between the top edge 200TE and the bottom edge 200BE. See FIG. 2J. The forward edge 200FE is located on an opposite side of the pocket 200 from the slit 200S. All of these edges 200TE, 200BE, 200FE are formed as bonds (e.g., adhesive bonds, weld bonds, etc.) in this illustrated example.

Additional potential features of the pocket 200 include features of its size and/or orientation on the upper 102. In some examples of this technology, the total interior pocket area (or unfixed area 200A) defined by the pocket 200, i.e., the area defined inside the top edge 200TE, the bottom edge 200BE, the forward edge 200FE, and the slit 200S (see FIG. 2I), may be within a range of 8 $cm^2$ to 40 $cm^2$, within a range of 10 $cm^2$ to 35 $cm^2$, within a range of 12 $cm^2$ to 30 $cm^2$, or even within a range of 10 $cm^2$ to 25 $cm^2$. As other potential features, e.g., as shown in FIGS. 2A and 2B, the slit 200S may be oriented to extend in a substantially top-to-bottom direction of the upper 102 (e.g., at an angle $\alpha$ of 65 degrees to 90 degrees (or even 75 degrees to 90 degrees, or 80 degrees to 90 degrees) with respect to a horizontal base line when the article of footwear 100 stands on its sole structure 104 in an unloaded condition). A bottom end 200SB of the slit 200S may be located further rearward than a top end 200ST of the slit 200.

In at least some examples of this technology, the pocket 200 will be integrally formed from two (or more) structural upper components, i.e., structural components provided in the upper 102 for purposes other than to form the pocket 200. In this illustrated example, the first upper component 102B that forms the inner side of the pocket 200 extends continuously at least from a first central rear heel location of the upper 102 (e.g., rearward of a parallel plane located at 0.05 L) at least to a first midfoot location of the upper 102 (e.g., forward of a parallel plane located at 0.4 L) and/or to another location forward of the unfixed space 200A (e.g., forward of a parallel plane located at 0.5 L, 0.6 L, or 0.7 L). Additionally or alternatively, the second upper component 102C that forms the outer side of the pocket 200 extends continuously at least from a second central rear heel location of the upper 102 (e.g., rearward of a parallel plane located at 0.05 L) at least to a second midfoot location of the upper 102 (e.g., forward of a parallel plane located at 0.4 L) and/or to another location forward of the unfixed space 200A (e.g., forward of a parallel plane located at 0.5 L, 0.6 L, or even 0.7 L). In this illustrated example, the first upper component 102B provides at least a portion of the heel-containing region of the upper 102. The second upper component 102C provides abrasion resistance, stretch resistance, and/or additional heel support to the upper 102. Thus, the components 102B and 102C forming the pocket 200 extend rearward and forward well beyond the unfixed space 200A forming the pocket 200. As some more specific examples, the footwear upper components 102B, 102C forming the pocket 200 may extend beyond the unfixed space 200A (i.e., the interior chamber) of the pocket 200 by at least 25 mm (and in some examples, at least 40 mm, at least 50 mm, at least 75 mm, or even at least 100 mm) in any direction (e.g., forward, rearward, to or around the rear heel area, to or across the instep area, upward, and/or downward from the pocket 200's unfixed space 200A).

As shown in FIGS. 2G and 2H together with FIGS. 2A-2F, the pocket 200 of this example may be loaded with the electronic module 210 by sliding the module 210 inward through the slit 200S (in the direction of arrow A in FIG. 2G) until it is received in the pocket 200. If at least a portion of the second upper component 102C in the area forming the pocket 200 is formed from an elastic material (e.g., a thermoplastic elastomer material, a spandex material, etc.), the resilience of the elastic material may help close the slit 200S, apply force to the electronic module 210, and hold the electronic module 210 in the pocket 200. To remove the electronic module 210 from the pocket 200, the user 250 can push outward on the front edge 210FE of the electronic module 210 through the second upper component 102C (see force arrow C in FIG. 2H), which can work the electronic module 210 rearward in the direction of arrow B, through the slit 200S, to a location where it exits the pocket 200 and/or can be grasped by the user 250.

In some examples of this technology, the structure forming the pocket 200 will consist only of or consist essentially of the first upper component 102B and the second upper component 102C bonded together to form an outer perimeter or boundary 200B of the unfixed space 200A (e.g., in a sewn seam-free manner). In the example of FIGS. 2A-2F, 2I, and 2J, however, a third upper component 102D forms a portion of the pocket 200. The third upper component 102D of this example includes a third inward facing surface 102DI and a third outward facing surface 102DO. At least a portion of the third inward facing surface 102DI in this example is fixed with (e.g., bonded to, including by a hot melt bonding adhesive) at least one of the first outward facing surface 102BO of the first upper component 102B or the second outward facing surface 102CO of the second upper component 102C. In the example of FIGS. 2A-2F, 2I, and 2J, a portion (200SD) of the slit 200S extends through the third upper component 102D from the third outward facing surface 102DO to the third inward facing surface 102DI. In the illustrated example of FIGS. 2A-2F, the third upper component 102D extends continuously at least from a third central rear heel location of the upper 102 at least to a third midfoot location of the upper 102 and/or a location forward of the unfixed space 200A of the pocket 200 (e.g., to any of the parallel plane locations and/or ranges described above for the first upper component 102B or the second upper component 102C). As some more specific examples, the third upper component 102D forming the pocket 200 may extend beyond the unfixed space 200A (i.e., the interior chamber) of the pocket 200 by at least 25 mm (and in some examples, at least 40 mm, at least 50 mm, at least 75 mm, or even at least 100 mm) in any direction (e.g., forward, rearward, to or around the rear heel area, to or across the instep area, upward, and/or downward from the pocket 200's unfixed space 200A). In some examples, the pocket 200 will consist only of or consist essentially of the first upper component 102B, the second upper component 102C, and the third upper component 102D bonded together (e.g., in a sewn seam-free manner). The third upper component 102D, when present, may be made from any desired material, e.g., including the materials described above for upper components 102B, 102C.

Figure 3A:
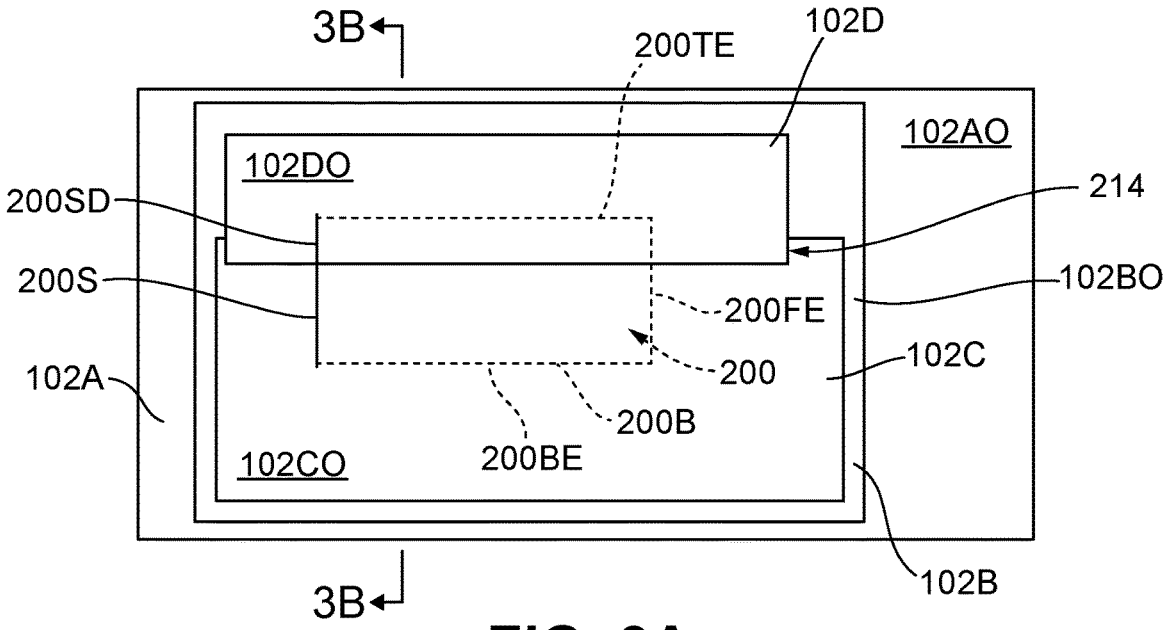
FIGS. 3A and 3B provide various views of a pocket-containing portion of an upper according to another example of this technology.
Figure 3B:
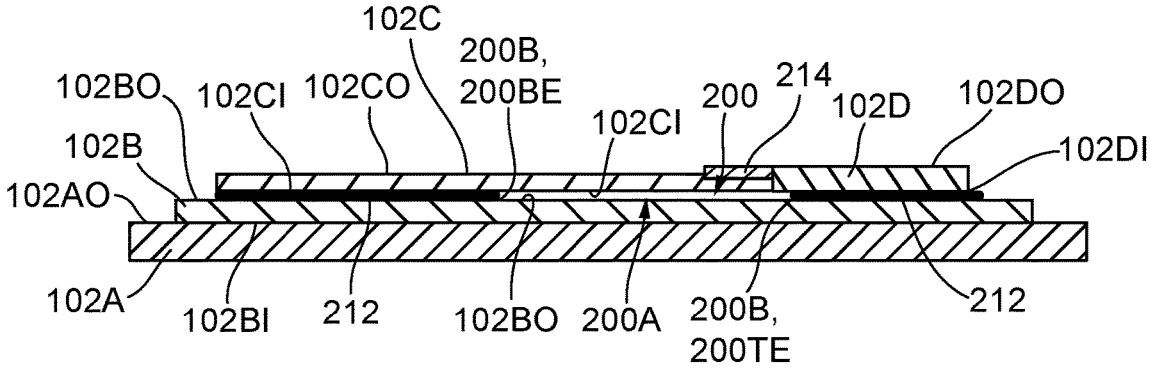

While FIGS. 2I and 2J illustrate the third upper component 102D engaged only with the second upper component 102C, FIGS. 3A and 3B show similar views as FIGS. 2I and 2J, respectively, in which the third upper component 102D is engaged with both: (a) the first upper component 102B (to its outward facing surface 102BO via bond material 212) and (b) the second upper component 102C (to its outward facing surface 102CO, optionally via an adhesive material). The second upper component 102C and the third upper component 102D may overlay, e.g., in region 214 and be bonded together at region 214. In the example of FIGS. 3A and 3B, a portion of the inward facing surface 102DI of the third upper component 102D defines an interior surface of the pocket 200 and is exposed in the unfixed space 200A. In both the illustrated examples of FIGS. 2A-2J and FIGS. 3A and 3B, the third upper component 102D may extend beyond the outer boundary 200B of the pocket 200 (e.g., as described above) and/or form a structural component of the upper 102 (e.g., a "skin" layer).

Figure 4:
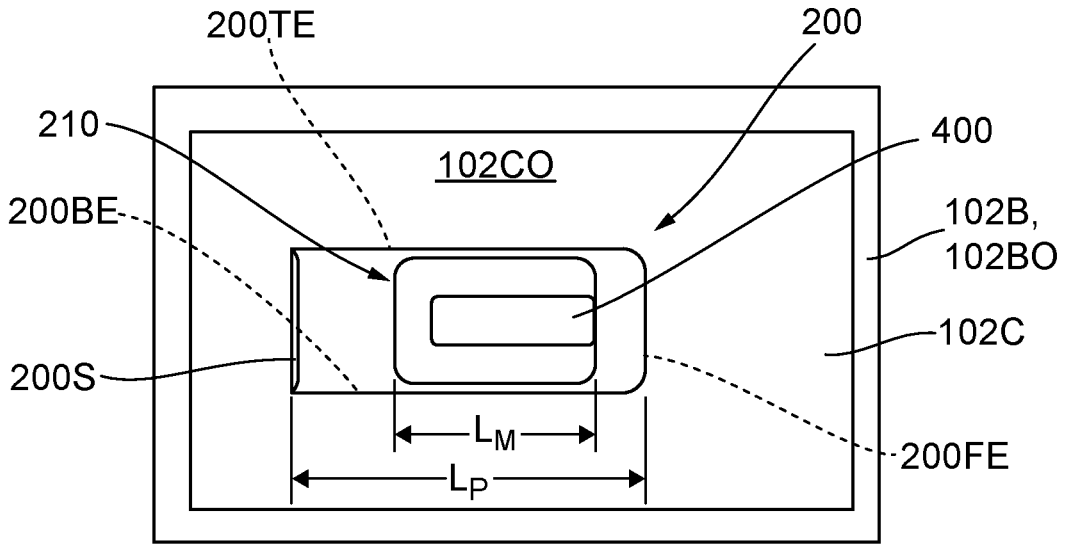
FIG. 4 provides a "face-on" view of a pocket-containing portion of an upper showing additional potential features according to some aspects of this technology.

FIG. 4 illustrates a "face-on" view of a pocket 200 of the general types described above formed between a first upper component 102B and a second upper component 102C with an electronic module 210 received in the pocket 200. Where the same reference numbers are used in FIG. 4 as used in FIGS. 1-3B, the same or similar parts are being referenced, and much of the corresponding overlapping description may be omitted. As shown in FIG. 4, the pocket 200 of this example includes a longitudinal length $L_P$, e.g., from the slit 200S to its opposite forward edge 200FE. In this illustrated example, the longitudinal length $L_P$ of the pocket 200 is longer than the longitudinal length $L_M$ of the electronic module 210 contained in the pocket 200. As some more specific examples, the pocket 200 may be sized such that $L_P$ at least $1.1\times L_M$, and in some examples, at least $1.2\times L_M$, at least $1.25\times L_M$, at least $1.3\times L_M$, at least $1.4\times L_M$, or even at least $1.5\times L_M$. Additionally or alternatively, in at least some examples of this technology, $L_P$ may be less than $3\times L_M$, and in some examples, less than $2.5\times L_M$, less than $2.25\times L_M$, less than $2\times L_M$, or even less than $1.75\times L_M$. The increased longitudinal length $L_P$ of the pocket 200's top layer 102C as compared to the module 210's length $L_M$ may help keep the module 210 within the unfixed space 200A of the pocket 200. This securing function can be provided and/or enhanced, at least in part, if at least one layer of the pocket 200 (e.g., the second upper component 102C in this example and/or the third upper component 102D in the example of FIGS. 2A-3B) includes an elastic material (such as a thermoplastic elastomer material, a spandex material, etc.). In such structures, placement of the module 210 in the pocket 200's unfixed space 200A can stretch the outer layer(s) (e.g., the second upper component 102C and/or the third upper component 102D) of the pocket 200. Then, as the pocket 200's layer(s) (e.g., 102C, 102D) return to or toward their original size and shape due to material elasticity, the slitted end of the pocket 200 may narrow and/or close and/or the module 210 otherwise may be held in place, e.g., by force incident from the resilience of the upper component(s) 102C, 102D pressing against the surface(s) of the module 210. Thus, in some examples of this technology, the footwear upper 102 may not need and may be free of separate components for closing the pocket 200 (e.g., no flaps, snaps, buttons, zippers, or the like are needed in some examples of this technology). All or just some portions of the second upper component 102C and/or third upper component 102D may be formed from elastic material to provide this resilience.

FIG. 4 further illustrates item 400 on the second upper component 102C at the pocket 200's location. Item 400 may take on various forms. As some more specific examples, item 400 may be an opening (through hole) or window (e.g., a transparent, partially transparent, translucent, or partially translucent panel), e.g., through second upper component 102C. A portion of the exterior surface of the module 210 may be exposed and/or visible through item 400. Such an opening or window as item 400 may be useful, for example, if the module 210 includes a display panel, one or more lights, one or more logos, one or more contrasting colors, or the like on its outer surface that are to be exposed and/or visible through item 400. Additionally or alternatively, providing item 400 as an opening or window may enable one to confirm easily whether a module 210 is present in the pocket 200. As another example, item 400 may constitute a "print receiving" area of second upper component 102C, e.g., an area onto which a manufacturer or other entity is able to print (e.g., screen print) any desired information, such as a logo; an area where a user can write any desired information; etc.

Figure 5A:
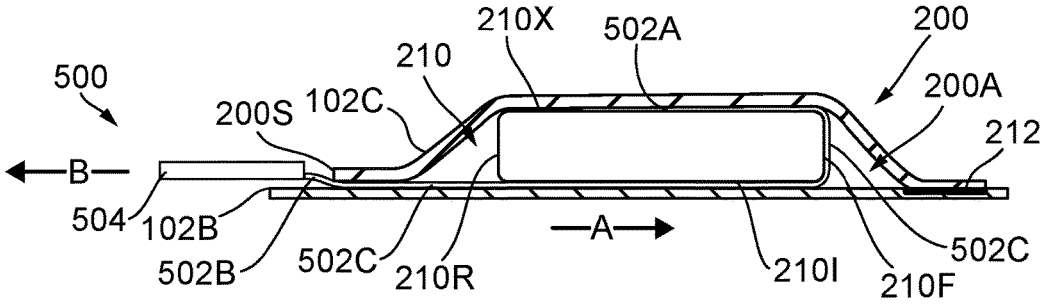
FIGS. 5A-5C provide various views of an example pocket-containing portion of an upper according to some aspects of this technology having a device release.
Figure 5B:
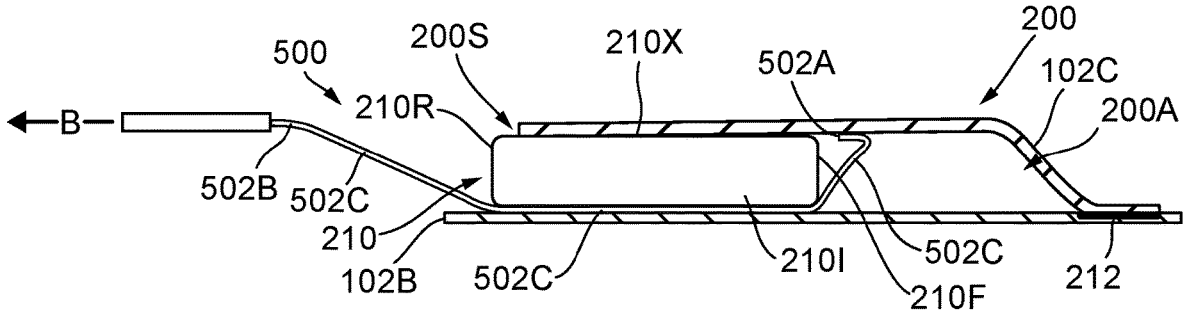
Figure 5C:
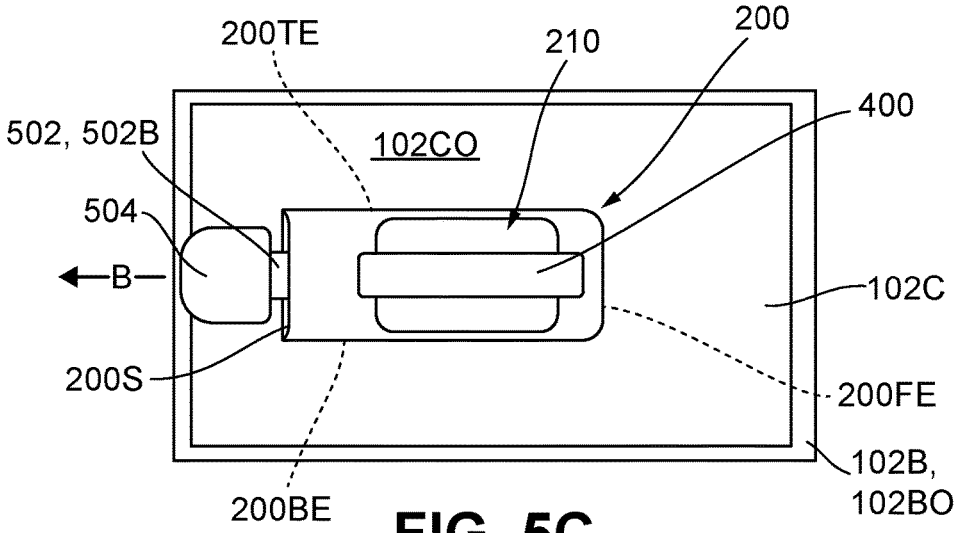

FIGS. 5A-5C illustrate additional features of footwear uppers 102 and pockets 200 included in them in accordance with some examples of this technology. Where the same reference numbers are used in FIGS. 5A-5C as used in FIGS. 1-4, the same or similar parts are being referenced, and much of the corresponding overlapping description may be omitted. FIGS. 5A and 5B are views showing the interior of the pocket 200 with an electronic module 210 mounted within its unfixed space 200A. FIG. 5C provides a "face-on" view of the exterior of the upper 102 at the pocket 200 area.

When the pocket 200 is longitudinally long, e.g., substantially longer than the electronic module 210, once the module 210 is in the pocket 200, it can be difficult to remove, e.g., to recharge the module 210, to download data from the module, etc. In some instances, efforts to remove the electronic module 210 could result in tearing the slit 200S and/or otherwise damaging the pocket 200 or upper 102. For these reasons, the example of FIGS. 5A-5C includes a device release 500 as part of the footwear upper 102 and the pocket 200. In this illustrated example, the device release 500 includes a strip of material 502 (e.g., a fabric material, a flexible plastic material, a ribbon, etc.) having: (i) a first end 502A engaged with the pocket 200 (e.g., with one of upper components 102B or 102C (and with second upper component 102C in this illustrated example)), (ii) a second end 502B opposite the first end 502A, and (iii) a body portion 502C extending from the first end 502A to the second end 502B. The body portion 502C may have sufficient length to extend through at least a portion of the unfixed space 200A of the pocket 200 and outward through the slit 200S such that the second end 502B is positionable outside the pocket 200. In this illustrated example, the second end 502B includes (or is engaged with) a pull-tab 504 (e.g., formed from a plastic or fabric material). The pull-tab 504 may have any desired size or shape.

FIG. 5A shows the electronic module 210 received in the unfixed space 200A of the pocket 200. In this arrangement, the body portion 502C of the strip of material 502: (a) extends along a forward end 210F of the electronic module 210, (b) along at least one of an interior facing surface 210I or an exterior facing surface 210X of the electronic module 210 (along the interior facing 210I in this illustrated example), (c) beyond a rearward end 210R of the electronic module 210, and (d) to the second end 502B of the strip of material 502. In fact, in this specifically illustrated example, when the electronic module 210 is received in the unfixed space 200A of the pocket 200: (i) the first end 502A of the strip of material 502 is engaged with the second upper component 102C (e.g., by sewing, by adhesive, etc.) at a location adjacent the exterior facing surface 210X of the electronic module 210 (e.g., at or near a center of the electronic module 210's longitudinal length), and (ii) the body portion 502C of the strip of material 502 extends along the exterior facing surface 210X, around the forward end 210F of the electronic module 210, along the interior facing surface 210I of the electronic module 210, and beyond the rearward end 210R of the electronic module 210 to the second end 502B of the strip of material 502 at the pull-tab 504.

In use, as the electronic module 210 is inserted into the pocket 200 (direction of arrow A in FIG. 5A), the forward end 210F of the electronic module 210 engages the strip of material 502 and the strip of material 502 will wrap the forward end of 210F of the module 210, e.g., in the manner shown in FIG. 5A. To release the electronic module 210 from the pocket 200, a user can pull the pull-tab 504 in the direction of arrow B. This action pulls the strip of material 502 rearward (in the direction of arrow B), which moves the electronic module 210 rearward toward the slit 200S. See FIG. 5B. If pulled far enough, the rearward end 210R of the electronic module 210 will exit the slit 200S to enable it to be grasped by a user or otherwise removed from the pocket 200.

Alternatively, if desired, the device release 500 could be vertically flipped with respect to the pocket 200 structure from the orientation shown in FIGS. 5A and 5B. More specifically, if desired, the device release 500 could be structured and arranged such that: (a) the strip of material 502's first end 502A is engaged with the first upper component 102B (at the interior facing surface 210I of the module 210), (b) the strip of material 502 wraps the forward end 210F of the module 210, (c) the strip of material 502 extends along the exterior facing surface 210X of the module, and (d) the strip of material 502 exits the pocket 200 at the slit 200S along the exterior facing surface 210X of the module 210 and joins to and/or ends at pull-tab 504.

Figure 6A:
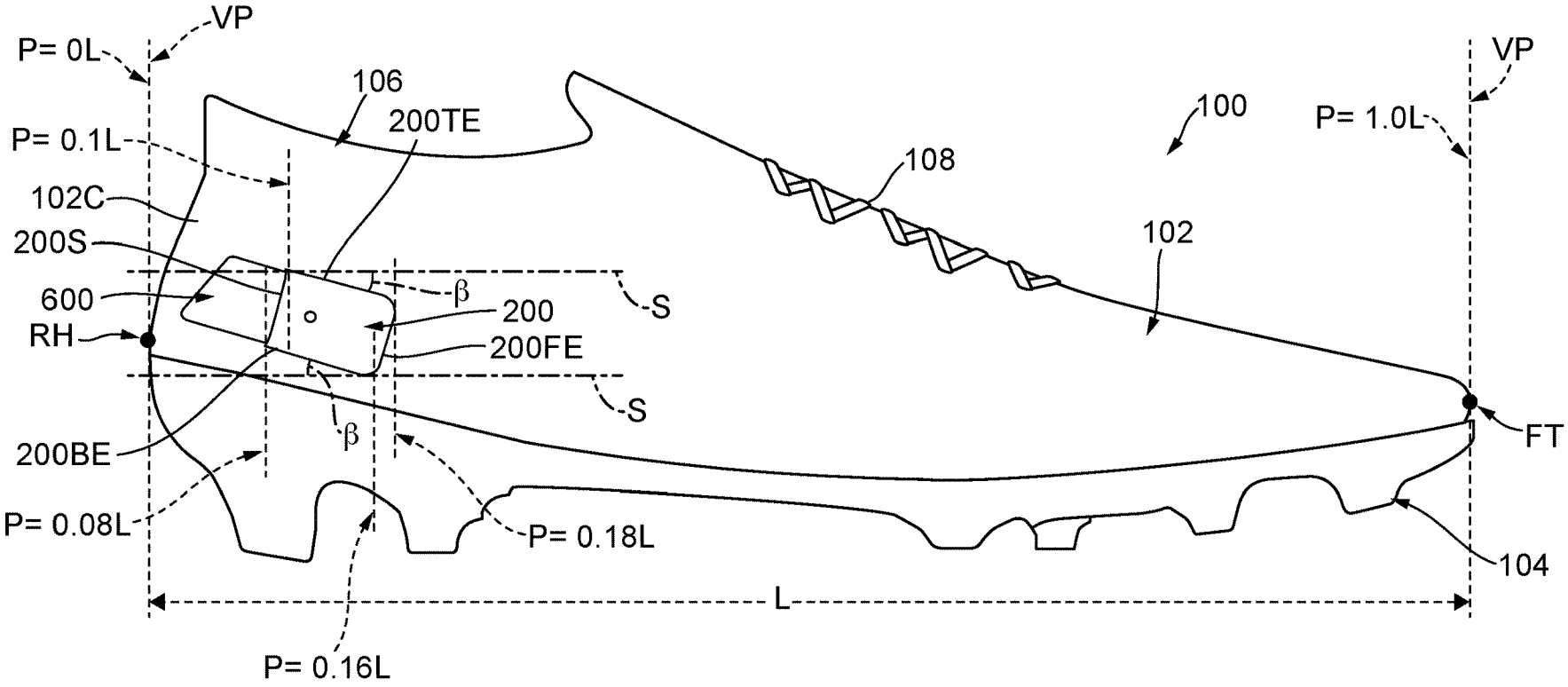
FIGS. 6A-7C provide various views of example pocket-containing portions of uppers according to some aspects of this technology having module retaining devices.
Figure 6B:
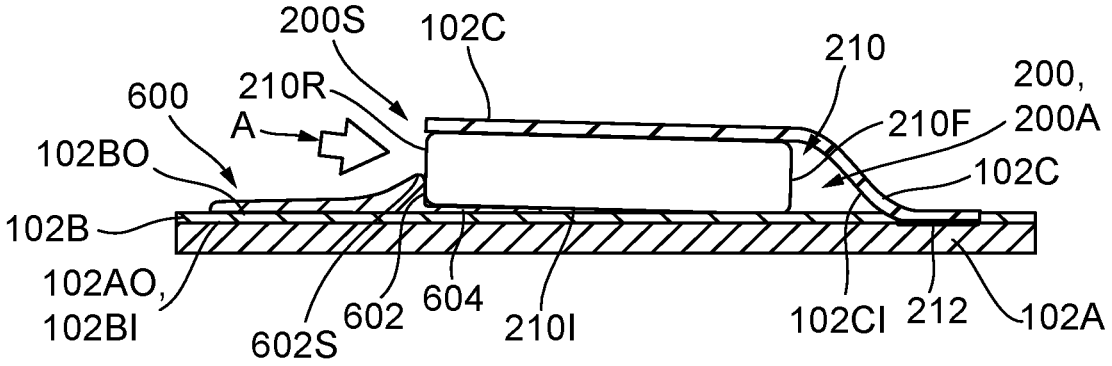
Figure 6C:
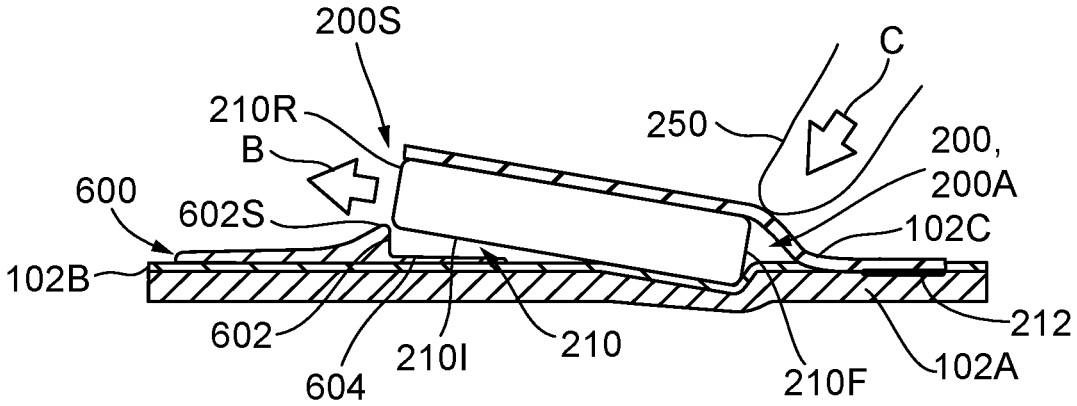
Figure 6D:
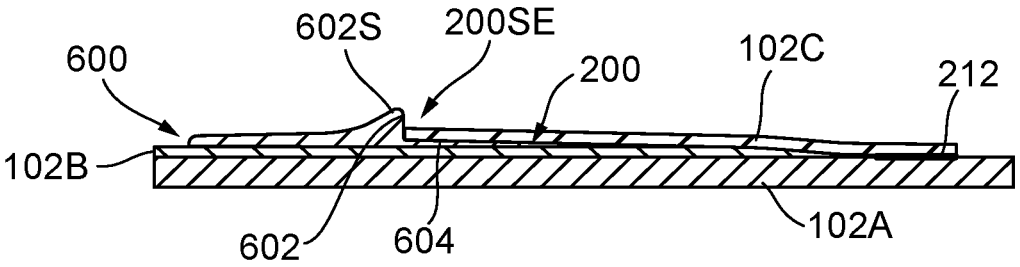

FIGS. 6A-6D illustrate additional features of articles of footwear, uppers, and pockets in accordance with some aspects of this technology. Where the same reference numbers are used in FIGS. 6A-6D as used in FIGS. 1-5C, the same or similar parts are being referenced, and much of the corresponding overlapping description may be omitted. FIG. 6A provides a lateral side view of the article of footwear 100 of this example. FIG. 6B shows the interior of the pocket 200 with an electronic module 210 mounted within its unfixed space 200A, FIG. 6C illustrates removal of the electronic module 210 from the pocket 200, and FIG. 6D illustrates the pocket 200 without an electronic module 210 mounted in it.

FIG. 6A shows that this example pocket 200 tilts downward in the rear-to-front direction of the upper 102 and article of footwear 100. Thus, the top edge 200TE and bottom edge 200BE of the pocket 200 extend downwardly from locations adjacent the slit 200S to the forward edge 200FE. As some more specific examples, one or both of the top edge 200TE and/or the bottom edge 200BE may extend downwardly at an angle β of 1 degree to 25 degrees with respect to a horizontal base line S (and in some examples, within an angle of 2 degrees to 20 degrees, or even 4 degrees to 16 degrees). This downward and forward tilt of the pocket 200, when present, can further help keep the module 210 within the pocket 200. Any examples of the pocket 200 described herein may have any of these same orientation and/or angular features.

Additionally or alternatively, as shown in FIG. 6A, in at least some examples of this technology, the rearward-most edge or rearward-most extent of the pocket 200 (e.g., the location of the slit 200S) may be located: (a) forward of a parallel plane located at 0.05 L (and in some examples, forward of a parallel plane located at 0.06 L, 0.08 L, or even 0.1 L) and/or (b) rearward of a parallel plane located at 0.18 L (and in some examples, rearward of a parallel plane located at 0.16 L, 0.14 L, or even 0.12 L). In this illustrated example, the rear bottom of the pocket 200 (the bottom of slit 200S) is located at a parallel plane located at 0.08 L and the rear top of the pocket 200 (the top of the slit 200S) is located at a parallel plane located at 0.1 L. Thus, the bottom of the slit 200S is located further rearward than the top of the slit 200S. Additionally or alternatively, in at least some examples of this technology, the forward-most edge or forward-most extent of the pocket 200 will be located: (a) rearward of a parallel plane located at 0.3 L (and in some examples, rearward of a parallel plane located at 0.27 L, 0.24 L, or even 0.2 L) and/or (b) forward of a parallel plane located at 0.15 L (and in some examples, forward of a parallel plane located at 0.18 L, 0.2 L, or even 0.22 L). In this illustrated example, the front bottom of the pocket 200 is located at a parallel plane located at 0.16 L and the front top of the pocket 200 is located at a parallel plane located at 0.18 L. The pocket 200 may extend an overall longitudinal length of: (a) at least 0.05 L, and in some examples, at least 0.06 L, at least 0.08 L, at least 0.1 L or even at least 0.12 L, and/or (b) less than 0.25 L, and in some examples, less than 0.22 L, less than 0.2 L, less than 0.18 L, even less than 0.16 L. Additionally or alternatively, in at least some examples of this technology, the pocket 200 will be positioned such that the rear edge of the electronic module 210, when positioned in the pocket 200, and/or the slit 200S will be located within a range of 30 mm to 75 mm from a rearmost, central heel location or rear, central heel seam of the upper 102 (and in some examples, within a range of 35 mm to 70 mm). Any examples of the pocket 200 described herein may have any of these same locational, longitudinal length, and/or positioning features.

In the example of FIGS. 6A-6D, the pocket 200's longitudinal length is relatively close to the longitudinal length of the electronic module 210. To help assure that the electronic module 210 remains housed in the pocket 200, the example footwear 100 structure of FIGS. 6A-6D includes a stop member 600 engaged with the upper 102 (e.g., with the first upper component 102B and/or with the second upper component 102C) and positioned proximate to the slit 200S. The stop member 600 may be engaged with the upper 102 in any desired manner, such as by adhesives, by sewing or stitching, by mechanical connectors, etc. The stop member 600 may be formed from a rigid, plastic material, e.g., a thermoplastic polyurethane material, a block copolymer made up of rigid polyamide blocks and soft polyether blocks, etc. FIG. 6B shows the electronic module 210 being inserted into the pocket 200 via the slit 200S by applying force in the direction of arrow A. In this example, the interior facing surface 210I of the electronic module 210 slides along the exposed surface 602S of the stop member 600 until the rearward edge 210R of the electronic module 210 slips past the raised ledge 602 of the stop member 600. An audible "click" may be generated as the electronic module 210 slides into place, particularly if the inward facing surface 210I of the electronic module 210 lands on a support base 604 of the stop member 600 that extends to or into the interior chamber of the pocket 200. Support base 604 may extend into the pocket 200 a relatively short distance (e.g., less than 40% of the longitudinal length of the pocket 200). In this configuration, the pocket-facing surface of the raised ledge 602 engages at least a portion (e.g., the bottom) of the rearward edge 210R of the electronic module 210 and helps hold the electronic module 210 within the pocket 200 (e.g., when the wearer runs, jumps, kicks, etc.).

To release the electronic module 210 from the pocket 200 in this example, the user 250 applies a downward and rearward force (arrow C) to the front edge 210F of the electronic module 210 as shown in FIG. 6C. This force can act to elevate the rear edge 210R of the electronic module 210 above the raised ledge 602 of the stop member 600. Further rearward force (arrow B) can allow the electronic module 210 to extend outward through the slit 200S and allow it to be removed from the pocket 200.

FIG. 6D illustrates the pocket 200 with the electronic module 210 fully removed. In this configuration, the elastic material forming at least a portion of second upper component 102C returns to its original and/or unstretched state (due to the resilience of the elastic material), thereby closing the pocket 200. Nonetheless, the slitted edge 200SE of the pocket 200 remains unattached or unfixed to other components to allow the pocket 200 to be reopened to receive an electronic module 210. If desired, a tab can be provided at the edge of the pocket 200 on second upper component 102C (e.g., near the slit 200S) to assist in getting the pocket 200 open.

Figure 7A:
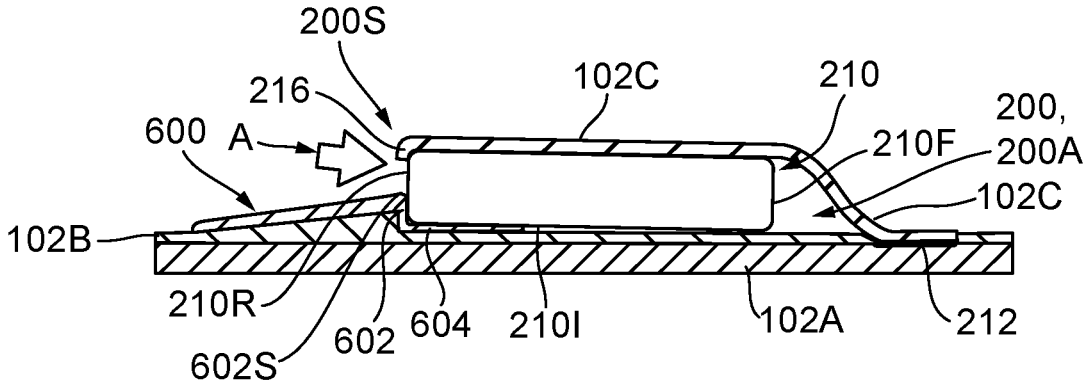
Figure 7B:
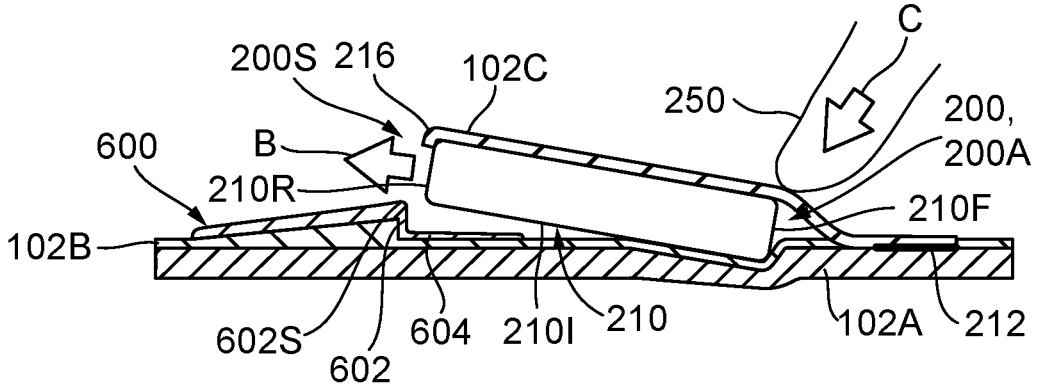
Figure 7C:
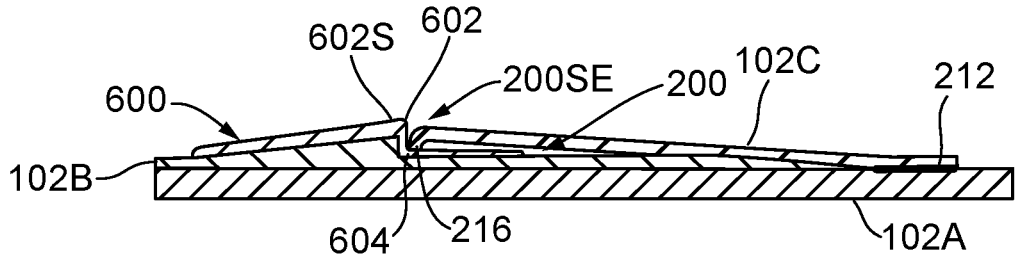

FIGS. 7A-7C provide views similar to FIGS. 6B-6D, respectively. Where the same reference numbers are used in FIGS. 7A-7C as used in FIGS. 1-6D, the same or similar parts are being referenced, and much of the corresponding overlapping description may be omitted. FIG. 7A shows the interior of the pocket 200 with an electronic module 210 mounted within its unfixed space 200A, FIG. 7B illustrates removal of the electronic module 210 from the pocket 200, and FIG. 7C illustrates the pocket 200 without an electronic module 210 mounted in it.

In the example of FIGS. 7A-7C, the pocket 200's longitudinal length again is relatively close to the longitudinal length of the electronic module 210. To help assure that the electronic module 210 remains housed in the pocket 200, the example footwear 100 structure of FIGS. 7A-7C includes a stop member 600 engaged with the upper 102 (e.g., with the first upper component 102B and/or with the second upper component 102C) and positioned proximate to the slit 200S. This illustrated example stop member 600 has a somewhat different cross sectional shape than the example of FIGS. 6A-6D, and a wide variety of stop member sizes and/or shapes can be provided without departing from this technology. Again, this stop member 600 may be formed from a rigid, plastic material, e.g., a thermoplastic polyurethane material, a block copolymer made up of rigid polyamide blocks and soft polyether blocks, etc. FIG. 7A shows the electronic module 210 being inserted into the pocket 200 via the slit 200S by applying force in the direction of arrow A. In this example, the interior facing surface 210I of the electronic module 210 slides along the exposed surface 602S of the stop member 600 until the rearward edge 210R of the electronic module 210 slips past the raised ledge 602 of the stop member 600. An audible "click" may be generated as the electronic module 210 slides into place (e.g., and on to support base 604, which may have the length features described above in conjunction with FIGS. 6A-6D). In this configuration, the pocket-facing surface of the raised ledge 602 engages at least a portion (e.g., the bottom) of the rearward edge 210R of the electronic module 210 and helps hold the electronic module 210 within the pocket 200.

Also, the second upper component 102C of this example includes a retaining lip 216 that extends downward to partially wrap a portion (e.g., the top) of the rearward edge 210R of the electronic module 210 and help hold the electronic module 210 within the pocket 200. If desired, some or all of the second upper component 102C (e.g., at least the region of the retaining lip 216) may be made from a rigid material, e.g., to allow the lip to engage and retain the electronic module 210. Such rigid materials may include plastics, metals, stiff fabrics, etc. As shown in FIG. 7A, the retaining lip 216 and the raised ledge 602 may have combined heights such that at least a portion of the rearward surface 210R of the electronic module 210 remains exposed when it is in the pocket 200. As some more specific examples, at least 35% to 75% of the height dimension of the electronic module 210 may remain exposed through the slit 200S in the example of FIG. 7A.

To release the electronic module 210 from the pocket 200 in this example, the user 250 applies a downward and rearward force (arrow C) to the front edge 210F of the electronic module 210 as shown in FIG. 7B. This force can act to elevate the rear edge 210R of the electronic module 210 above the raised ledge 602 of the stop member 600. Further rearward force (arrow B) can allow the electronic module 210 to extend outward through the slit and allow it to be removed from the pocket 200. If necessary, the user 250 may need to maneuver the retaining lip 216 over the rearward edge 210R to assist in removing the electronic module 210 from the pocket 200.

FIG. 7C illustrates the pocket 200 with the electronic module 210 fully removed. In this configuration, the elastic material forming at least a portion of second upper component 102C returns to its original and/or unstretched state (due to the resilience of the elastic material), thereby closing the pocket 200. Nonetheless, the slitted edge 200SE of the pocket 200 remains unattached or unfixed to other components to allow the pocket 200 to be reopened to receive an electronic module 210. FIG. 7C further shows the retaining lip 216 at the edge of slit 200S. If desired, a tab can be provided at the edge of the pocket 200 on second upper component 102C (e.g., near the slit 200S and/or at the retaining lip 216) to assist in getting the pocket 200 open.

As described above, in some examples of this technology the upper 102 may be formed, at least in part, by heating and pressing techniques, e.g., flat pressing techniques, such as the techniques described in U.S. Pat. No. 9,723,895 B2. Further aspects of methods of forming upper components including an integrated pocket 200 in accordance with some examples of this technology are described in conjunction with FIGS. 8 and 9. Where the same reference numbers are used in FIGS. 8-9 as used in FIGS. 1-7C, the same or similar parts are being referenced, and much of the corresponding overlapping description may be omitted.

Figure 8:
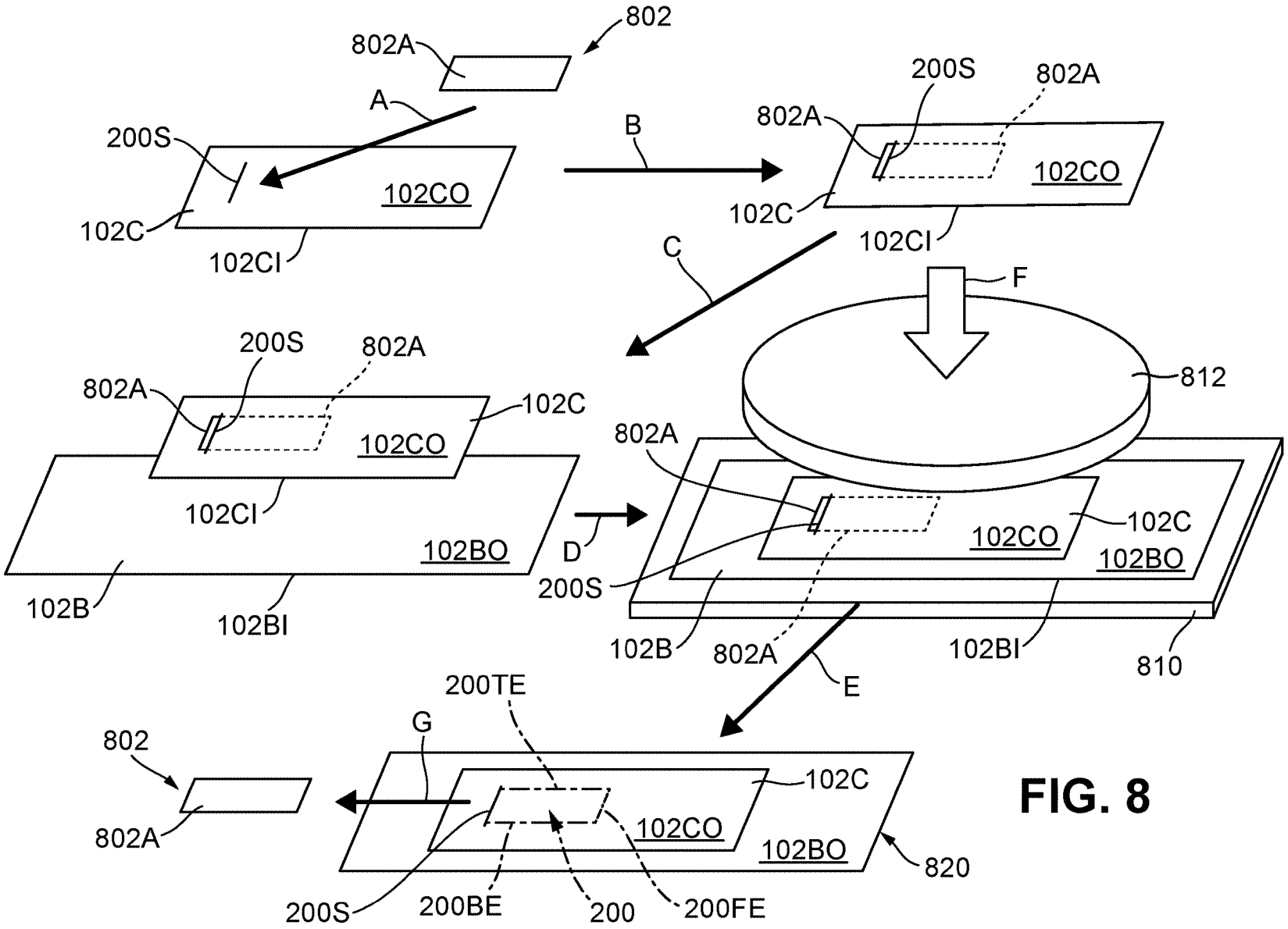
FIGS. 8 and 9 provide various views of method steps in accordance with some aspects of this technology.

In the example method steps shown in FIG. 8, a slit 200S is formed through the second upper component 102C. The slit 200S extends completely through the second upper component 102C, from its outward facing surface 102CO to its inward facing surface 102CI. The inward facing surface 102CI of the second upper component 102C may have a hot melt adhesive or other adhesive material applied to it.

An adhesion-inhibiting component 802 may be applied to the second upper component 102C in the area where the unfixed space 200A of the pocket 200 component is desired. In the illustrated example, the adhesion-inhibiting component 802 comprises a sheet of material 802A. The sheet of material 802A is placed to extend through the slit 200S so that a portion of the sheet of material 802A is located on the inward facing surface 102CI (shown in broken lines at the top right of FIG. 8). See arrows A and B. The edges of the sheet of material 802A are located to form the edges of the pocket 200, and the unfixed space 200A of the pocket 200 will correspond to the location of the sheet of material 802A. The sheet of material 802A may be formed from a material that does not bond to the hot melt adhesive (or other adhesive) provided on the second upper component 102C (and/or on the first upper component 102B). In the example of FIG. 8, a portion of the sheet of material 802A is located on the outward facing surface 102CO of the second upper component 102C and a portion is located on the inward facing surface 102CI (shown in broken lines in FIG. 8), such that the sheet of material 802A extends through the slit 200S.

Then, the second upper component 102C (with the adhesion-inhibiting component 802 included with it) is arranged on the first upper component 102B. See arrows C and D in FIG. 8. Each of the first upper component 102B and the second upper component 102C may be formed as sheets or flat pieces of material. The first upper component 102B includes an outward facing surface 102BO and an inward facing surface 102BI. The second upper component 102C is applied to the first upper component 102B such that inward facing surface 102CI of the second upper component 102C directly faces (and directly contacts) the outward facing surface 102BO of the first upper component 102B. Also, a portion of the adhesion-inhibiting component 802 (i.e., the portion positioned to form the pocket 200) is sandwiched between the inward facing surface 102CI of the second upper component 102C and the outward facing surface 102BO of the first upper component 102B. Alternatively, if desired, the adhesion-inhibiting component 802 (or at least a portion thereof) may be applied to or placed on the first upper component 102B rather than the second upper component 102C and/or the adhesion-inhibiting component 802 (or at least a portion thereof) may be applied or placed after the first upper component 102B and the second upper component 102C are placed together.

The combined first upper component 102B, second upper component 102C, and adhesion-inhibiting component 802 may be mounted on a support plate 810 for pressing by press plate 812. The first upper component 102B and the second upper component 102C may have holes formed therein (e.g., along their edges), and these holes may engage pins provided on the support plate 810 or on a component held by support plate 810. Such use of holes engaging pins and pressing to engage upper components together by hot melt processes are described, for example, in U.S. Pat. No. 9,723,895 B2. Press plate 812 and/or support plate 810 may be heated to a sufficient temperature to activate the hot melt adhesive applied to one or both of first upper component 102B and/or second upper component 102C, and the plates 810, 812 may be pressed together (see force arrow F). Sufficient heat and pressure activate the hot melt adhesive thereby bonding inward facing surface 102CI of the second upper component 102C with the outward facing surface 102BO of the first upper component 102B. Once bonded, the combined first upper component 102B and second upper component 102C may be removed from the support plate 810 as a single upper component 820. See arrow E in FIG. 8.

Due to the presence of the adhesion-inhibiting component 802, however, a portion of the inward facing surface 102CI of the second upper component 102C does not bond to the outward facing surface 102BO of the first upper component 102B (shown by dot-dash lines in FIG. 8). Rather, the areas of at least one of the first upper component 102B and/or the second upper component 102C contacting the adhesion-inhibiting component 802 will not fix to the adhesion-inhibiting component 802 such that an unfixed space remains between the inward facing surface 102CI and the outward facing surface 102BO. The adhesion-inhibiting component 802 then may be removed, if desired (e.g., pulled out through the slit 200S), and the pocket 200 remains. See arrow G in FIG. 8. Alternatively, the adhesion-inhibiting component 802 may remain within the pocket 200 (e.g., provided at least one surface of the adhesion-inhibiting component 802 is not fixed to one of upper component 102B and/or 102C). The slit 200S provides access to the unfixed space 200A of the pocket 200.

Any desired type of adhesion-inhibiting component 802 may be used with this technology. In this illustrated example, the adhesion-inhibiting component 802 comprises a release liner or release paper that extends through the slit 200S so that a portion of the release liner extends between the inward facing surface 102CI of the second upper component 102C and the outward facing surface 102BO of the first upper component 102B. The release liner (or at least one or both outer surfaces thereof) is formed from a material that does not adhere (bond) to the first upper component 102B, the second upper component 102C, and/or the hot melt adhesive under the applied heat and pressure conditions. As another example, the adhesion-inhibiting component 802 may comprise a folded sheet of paper, fabric, or other material that optionally may be allowed to remain within the upper structure (so that the facing surfaces of the paper, fabric, or other material form interior surfaces of the pocket 200). As yet another example, the adhesion-inhibiting component 802 may comprise a liquid, gel, sticker(s), or coating, e.g., applied to the first upper component 102B and/or the second upper component 102C at the area where the unfixed area 200A of the pocket 200 is desired. As yet another option, adhesion-inhibiting could be provided by not applying hot melt adhesive and/or other adhesive material to one or both of the inward facing surface 102CI of the second upper component 102C and the outward facing surface 102BO of the first upper component 102B at the desired location of the pocket 200. Such adhesion-inhibiting components 802 constitute "pocket forming arrangements," as that term is used herein.

In this illustrated example, an outer boundary of the unfixed space 200A of the pocket 200 is defined by an attached perimeter where the outward facing surface 102BO of the first upper component 102B is bonded to the inward facing surface 102CI of the second upper component 102C. In some examples, 100% of this attached perimeter will be formed in a sewn seam-free manner (i.e., without any sewing or stitching). This outer boundary of the unfixed space 200A of the pocket 200 may include: (i) a top edge 200TE, (ii) a bottom edge 200BE, and (iii) a forward edge 200FE extending between the top edge 200TE and the bottom edge 200BE and located on an opposite side of the pocket 200 from the slit 200S. Note FIGS. 2I, 3A, 4, 5C, 6A, and 8. At these edges 200TE, 200BE, 200FE, the outward facing surface 102BO of the first upper component 102B is bonded to the inward facing surface 102CI of the second upper component 102C.

While not shown in FIG. 8, if desired, additional upper components, including one or more additional upper components forming the pocket 200 (e.g., third upper component 102D described above in conjunction with FIGS. 2A-3B), may be included on the support plate 810 and pressed by press plate 812 during the heat and pressure applying step(s). Indeed, multiple components (e.g., for a complete footwear upper 102) may be arranged and pressed in this one step. Holes may be provided in such components to engage corresponding pins on the support plate 810 for pressing, e.g., in the manner described in U.S. Pat. No. 9,723,895 B2. The upper components may have any desired size and/or shape and may form structural components of the upper 102. Once the upper 102 is formed, it may be engaged with a sole structure 104 to form an article of footwear 100, e.g., in conventional manners as are known and used in the footwear art. Such additional upper components also may be provided in the method of FIG. 9 described below.

Figure 9:
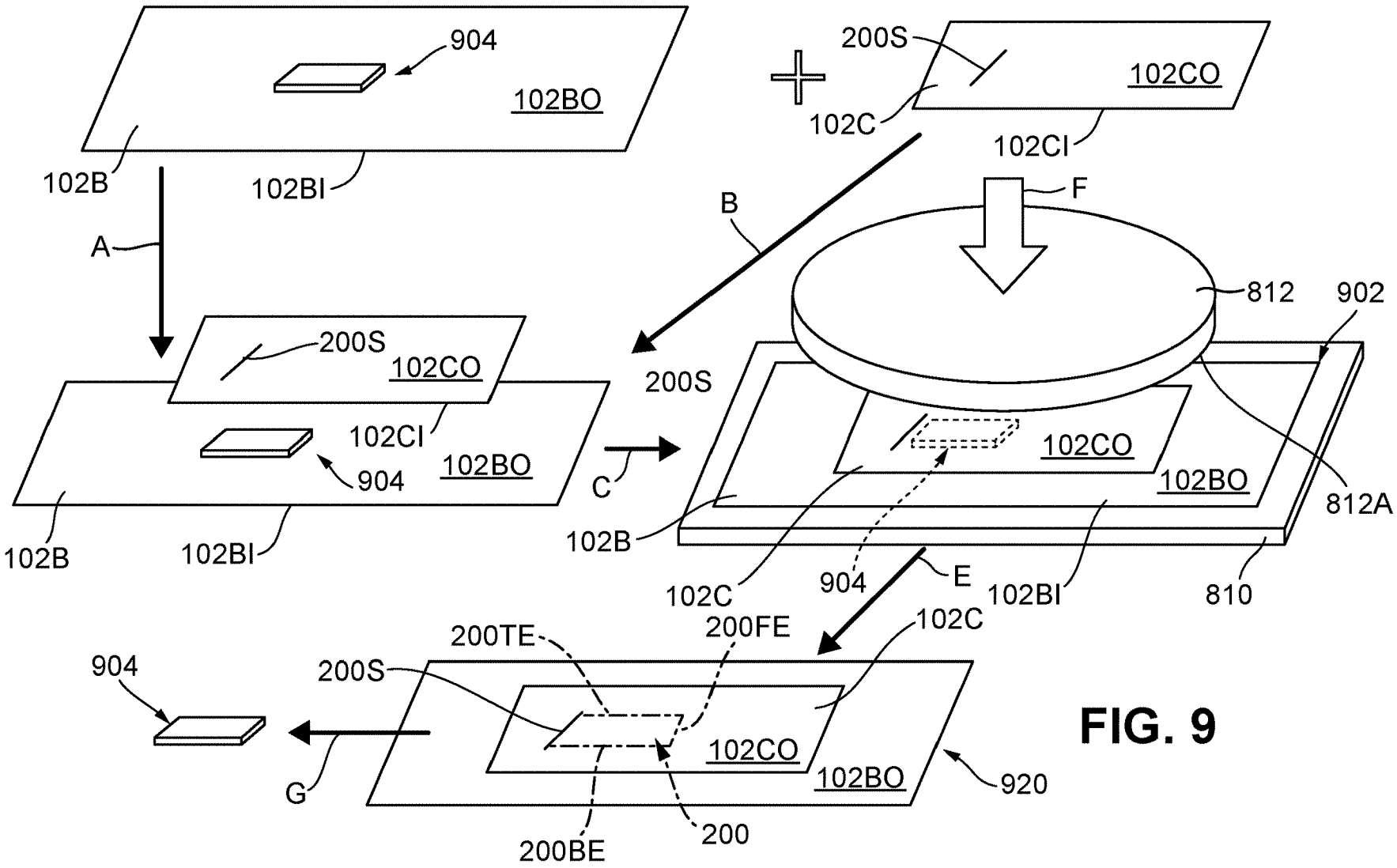

FIG. 9 illustrates another example method of forming an upper for an article of footwear 100 in accordance with some aspects of this technology. In the example of FIG. 9, an upper preform 902 is built by placing a three-dimensional blank 904 between the outward facing surface 102BO of a first upper component 102B and an inward facing surface 102CI of a second upper component 102C. See arrows A and B in FIG. 9. The three-dimensional blank 904 constitutes another example of a "pocket forming arrangement," as that term is used herein. The three-dimensional blank 904 may be used along with an adhesion-inhibiting component 802 and/or the three-dimensional blank 904 may constitute the adhesion-inhibiting component (e.g., if the surface(s) of the three-dimensional blank 904 will not bond to the upper components 102B and/or 102C under the processing conditions to be used). The three-dimensional blank 904 is placed adjacent a slit 200S formed in the second upper component 102C and between the first upper component 102B and second upper component 102C. The term "adjacent" as used in this context, means that the blank 904 is sufficiently close to the slit 200S such that the slit 200S will remain open to the unfixed area of 200A after the processing conditions to form the pocket 200 are completed. Alternatively, if desired, the upper components 102B and 102C (and any others) may be pressed and bonded together with the three-dimensional blank 904 in place and the slit 200S may be formed after the pressing and bonding steps. The three-dimensional blank 904 may be deformable (e.g., made from a foam material), e.g., to allow it to be more easily removed from the upper 102 after the pocket 200 is formed.

The combined first upper component 102B, second upper component 102C, and three-dimensional blank 904 (also called "upper preform" 902 herein) then is mounted on a support plate 810 for pressing by press plate 812. See arrow C in FIG. 9. The first upper component 102B and the second upper component 102C may have holes formed therein (e.g., along their edges), and these holes may engage pins provided on the support plate 810 or a component held by support plate 810. Such use of holes engaging pins and pressing to engage upper components together by hot melt processes are described, for example, in U.S. Pat. No. 9,723,895 B2. Press plate 812 and/or support plate 810 may be heated to a sufficient temperature to activate the hot melt adhesive applied to one or both of first upper component 102B and/or second upper component 102C, and the plates 810, 812 may be pressed together (see force arrow F). Sufficient heat and pressure activate the hot melt adhesive thereby bonding inward facing surface 102CI of the second upper component 102C with the outward facing surface 102BO of the first upper component 102B. The press plate 812 may have a conformable pressing surface 812A, a hole or recess, and/or other structure to allow it to deform or move around the three-dimensional blank 904 and/or otherwise apply pressure to the upper components 102B, 102C at locations at or adjacent the three-dimensional blank 904. Additionally or alternatively, the three-dimensional blank 904 may be deformable (e.g., a block of foam material). Once bonded, the combined first upper component 102B, second upper component 102C, and three-dimensional blank 904 may be removed from the support plate 810 as a single upper component 920. See arrow E in FIG. 9.

Due to the presence of the three-dimensional blank 904, however, a portion of the inward facing surface 102CI of the second upper component 102C does not bond to the outward facing surface 102BO of the first upper component 102B (shown by dot-dash lines in FIG. 9). Rather, the areas of the first upper component 102B and second upper component 102C contacting the three-dimensional blank 904 remain as unfixed space between the inward facing surface 102CI and the outward facing surface 102BO. The three-dimensional blank 904 then may be removed (e.g., pulled out through the slit 200S), and the pocket 200 remains. See arrow G in FIG. 9. The slit 200S provides access to the unfixed space 200A of the pocket 200.

Aspects of this technology may be advantageous in several ways. For example, some aspects of this technology may be advantageous because they allow a user accessible pocket 200 to be formed in a footwear upper 102 in an easy manner using only the main structural components of the upper 102 (e.g., without adding separate pocket components to an existing upper construction). Additionally or alternatively, the pocket 200 can be easily formed in existing upper production processes with minimal additional processing steps and/processing time (e.g., without the need for a separate step of sewing a pocket into or onto an upper structure). Additionally or alternatively, in at least some examples of this technology, the upper pocket 200 is formed in a non-obtrusive location (e.g., at the rear, lateral heel area of the upper) and/or with a minimalist or streamlined profile or exterior footprint on the upper 102. Thus, the pocket 200 (and any electronic module 210 or other component placed therein) is located in an "out-of-the-way" location, may not be readily visible to the wearer, and/or will be unlikely to affect athletic performance (e.g., unlikely to contact the ball during play).

III. CONCLUSION

The present technology is disclosed above and in the accompanying drawings with reference to a variety of embodiments. The purpose served by the disclosure, however, is to provide an example of the various features and concepts related to the technology, not to limit its scope. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. An upper for an article of footwear, comprising:

a first upper component having a first inward facing surface and a first outward facing surface; and a second upper component having a second inward facing surface and a second outward facing surface, wherein a portion of the second inward facing surface is fixed with a portion of the first outward facing surface, wherein the first upper component and the second upper component define a pocket that includes: (a) the first outward facing surface, (b) the second inward facing surface, (c) a slit extending through the second upper component from the second outward facing surface to the second inward facing surface, and (d) an unfixed space between the first outward facing surface and the second inward facing surface where the second inward facing surface is unfixed with the first outward facing surface, wherein the slit provides access to the unfixed space.

Clause 2. The upper according to Clause 1, wherein an outer boundary of the unfixed space of the pocket is defined by an attached perimeter where the second inward facing surface is attached to the first outward facing surface, wherein 100% of the attached perimeter is formed in a sewn seam-free manner.

Clause 3. The upper according to Clause 1, wherein an outer boundary of the unfixed space of the pocket includes: (i) a top edge where the first outward facing surface is bonded to the second inward facing surface, (ii) a bottom edge where the first outward facing surface is bonded to the second inward facing surface, and (iii) a forward edge where the first outward facing surface is bonded to the second inward facing surface, wherein the forward edge extends between the top edge and the bottom edge, and wherein the forward edge is located on an opposite side of the pocket from the slit.

Clause 4. The upper according to Clause 3, wherein the top edge extends downwardly from a location adjacent the slit to the forward edge.

Clause 5. The upper according to Clause 4, wherein the top edge extends downwardly at an angle of 1 degree to 25 degrees with respect to a horizontal base line.

Clause 6. The upper according to any one of Clauses 3 to 5, wherein the bottom edge extends downwardly from a location adjacent the slit to the forward edge.

Clause 7. The upper according to Clause 6, wherein the bottom edge extends downwardly at an angle of 1 degree to 25 degrees with respect to a horizontal base line.

Clause 8. The upper according to any one of Clauses 3 to 7, wherein the top edge, the bottom edge, the forward edge, and the slit define a total interior pocket area within a range of 10 $cm^2$ to 25 $cm^2$.

Clause 9. The upper according to any one of Clauses 1 to 8, wherein the slit is oriented to extend in a substantially top-to-bottom direction of the upper.

Clause 10. The upper according to Clause 9, wherein the slit extends at an angle of 75 degrees to 90 degrees with respect to a horizontal base line.

Clause 11. The upper according to any one of Clauses 1 to 10, wherein a bottom end of the slit is located further rearward than a top end of the slit.

Clause 12. The upper according to any one of Clauses 1 to 11, wherein the first upper component extends continuously at least from a first central rear heel location of the upper to a first midfoot location of the upper located forward of the unfixed space, and wherein the second upper component extends continuously at least from a second central rear heel location of the upper to a second midfoot location of the upper located forward of the unfixed space.

Clause 13. The upper according to any one of Clauses 1 to 12, wherein the slit is located at a lateral rear heel location of the upper.

Clause 14. The upper according to any one of Clauses 1 to 13, wherein the unfixed space extends forward from the slit.

Clause 15. The upper according to any one of Clauses 1 to 14, wherein the second upper component includes an elastic material.

Clause 16. The upper according to any one of Clauses 1 to 15, wherein the slit is exposed at an exterior surface of the upper in all configurations of the upper.

Clause 17. The upper according to any one of Clauses 1 to 16, wherein the upper is free of separate components for closing the pocket.

Clause 18. The upper according to any one of Clauses 1 to 17, wherein the pocket consists essentially of the first upper component and the second upper component bonded together to form an outer perimeter of the unfixed space.

Clause 19. The upper according to any one of Clauses 1 to 17, further comprising: a third upper component having a third inward facing surface and a third outward facing surface, wherein at least a portion of the third inward facing surface is fixed with at least one of the first outward facing surface or the second outward facing surface.

Clause 20. The upper according to Clause 19, wherein a portion of the slit extends through the third upper component from the third outward facing surface to the third inward facing surface.

Clause 21. The upper according to any one of Clauses 19 to 20, wherein the third upper component extends continuously at least from a third central rear heel location of the upper to a third midfoot location of the upper located forward of the unfixed space.

Clause 22. The upper according to any one of Clauses 19 to 21, wherein the third upper component includes an elastic material.

Clause 23. The upper according to any one of Clauses 1 to 22, further comprising: a device release engaged with the pocket.

Clause 24. The upper according to Clause 23, wherein the device release is engaged with the second inward facing surface of the second upper component.

Clause 25. The upper according to Clause 23, wherein the device release includes a strip of material having a first end engaged with the pocket, a second end opposite the first end, and a body portion extending from the first end to the second end; wherein the body portion extends through at least a portion of the unfixed space; and wherein the body portion has a sufficient length to extend through the slit such that the second end is positionable outside the pocket.

Clause 26. The upper according to any one of Clauses 1 to 22, further comprising: an electronic module received in the unfixed space of the pocket.

Clause 27. The upper according to Clause 26, wherein the unfixed space of the pocket has a longitudinal dimension in a heel-to-toe direction of the upper that is at least 1.25 times greater than a dimension of the electronic module extending in the heel-to-toe direction of the upper when received in the pocket.

Clause 28. The upper according to Clause 26 or 27, further comprising: a device release engaged with the pocket.

Clause 29. The upper according to Clause 28, wherein the device release is engaged with the second inward facing surface of the second upper component.

Clause 30. The upper according to Clause 28 or 29, wherein the device release includes a strip of material having a first end engaged with the pocket, a second end opposite the first end, and a body portion extending from the first end to the second end; wherein the body portion extends through at least a portion of the unfixed space; and wherein the body portion has a sufficient length to extend through the slit such that the second end is positionable outside the pocket.

Clause 31. The upper according to Clause 30, wherein when the electronic module is received in the unfixed space, the body portion of the strip of material extends along a forward end of the electronic module, along at least one of an interior facing surface or an exterior facing surface of the electronic module, and beyond a rearward end of the electronic module to the second end of the strip of material.

Clause 32. The upper according to Clause 30, wherein when the electronic module is received in the unfixed space: (i) the first end of the strip of material is engaged with the second upper component at a location adjacent an exterior facing surface of the electronic module, and (ii) the body portion of the strip of material extends along the exterior facing surface, around a forward end of the electronic module, along an interior facing surface of the electronic module, and beyond a rearward end of the electronic module to the second end of the strip of material.

Clause 33. The upper according to any one of Clauses 1 to 22, further comprising: a stop member engaged with at least one of the first upper component or the second upper component and positioned proximate to the slit.

Clause 34. The upper according to Clause 33, further comprising: an electronic module received in the unfixed space of the pocket, the electronic module including a rearward edge located proximate to the stop member.

Clause 35. The upper according to Clause 33, wherein the stop member includes a first raised ledge extending in a direction along at least a portion of the slit.

Clause 36. The upper according to Clause 35, further comprising: an electronic module received in the unfixed space of the pocket, the electronic module including a rearward edge located proximate to the first raised ledge of the stop member.

Clause 37. The upper according to any one of Clauses 33 to 36, wherein the stop member is formed from a rigid plastic material.

Clause 38. The upper according to any one of Clauses 1 to 37, wherein at least a portion of the second upper component is formed from an at least partially transparent material or an at least partially translucent material.

Clause 39. The upper according to any one of Clauses 1 to 38, wherein an exterior edge of the second upper component at the slit forms a retaining lip.

Clause 40. The upper according to Clause 39, further comprising an electronic module received in the unfixed space of the pocket, wherein a rearward end of the electronic module engages the retaining lip.

Clause 41. An article of footwear, comprising: an upper according to any one of Clauses 1 to 40; and a sole structure engaged with the upper.

Clause 42. A method of forming a footwear upper, comprising:

providing a first upper component having a first surface and a second surface opposite the first surface;

forming a slit in a second upper component, the second upper component having a third surface and a fourth surface opposite the third surface, the slit extending from the third surface to the fourth surface;

arranging the first upper component and the second upper component such that the second surface directly faces the third surface;

creating a pocket-forming arrangement between the second surface and the third surface (e.g., by placing at least a first portion of an adhesion-inhibiting component between the second surface and the third surface adjacent a location for the slit, by removing adhesive or adhesive precursor from portions of the second surface and/or the third surface adjacent a location for the slit, by not applying adhesive or adhesive precursor to portions of the second surface and/or the third surface adjacent a location for the slit, and/or by placing a three-dimensional blank between the second surface and the third surface adjacent a location for the slit, etc.); and applying heat and/or pressure to bond the first upper component to the second upper component at locations around the pocket-forming arrangement to define a pocket as unfixed space between the second surface and the third surface, the unfixed space forming due to the presence of the pocket-forming arrangement, wherein the slit provides access to the unfixed space.

Clause 43. The method according to Clause 42, wherein the creating step includes placing a release liner through the slit so that a portion of the release liner extends between the second surface and the third surface.

Clause 44. The method according to Clause 42 or 43, wherein an outer boundary of the unfixed space of the pocket is defined by an attached perimeter where the second surface is bonded to the third surface, wherein 100% of the attached perimeter is formed in a sewn seam-free manner.

Clause 45. The method according to Clause 42 or 43, wherein an outer boundary of the unfixed space of the pocket includes: (i) a top edge where the second surface is bonded to the third surface, (ii) a bottom edge where the second surface is bonded to the third surface, and (iii) a forward edge where the second surface is bonded to the third surface, wherein the forward edge extends between the top edge and the bottom edge, and wherein the forward edge is located on an opposite side of the pocket from the slit.

Clause 46. The method according to Clause 45, wherein the top edge extends from a location adjacent the slit to the forward edge.

Clause 47. The method according to Clause 45 or 46, wherein the bottom edge extends from a location adjacent the slit to the forward edge.

Clause 48. The method according to any one of Clauses 45 to 47, wherein the top edge, the bottom edge, the forward edge, and the slit define a total interior pocket area within a range of 10 $cm^2$ to 25 $cm^2$.

Clause 49. The method according to any one of Clauses 42 to 48, further comprising arranging the second upper component such that the slit is oriented to extend in a substantially top-to-bottom direction of the footwear upper.

Clause 50. The method according to Clause 49, wherein the second upper component is arranged such that the slit extends at an angle of 75 degrees to 90 degrees with respect to a horizontal base line.

Clause 51. The method according to any one of Clauses 42 to 50, wherein the slit is formed such that a bottom end of the slit is located further rearward than a top end of the slit.

Clause 52. The method according to any one of Clauses 42 to 51, wherein the first upper component extends continuously at least from a first central rear heel location of the footwear upper to a first midfoot location of the footwear upper located forward of the unfixed space, and wherein the second upper component extends continuously at least from a second central rear heel location of the footwear upper to a second midfoot location of the footwear upper located forward of the unfixed space.

Clause 53. The method according to any one of Clauses 42 to 52, wherein the slit is located at a lateral rear heel location of the footwear upper.

Clause 54. The method according to any one of Clauses 42 to 53, wherein the unfixed space extends forward from the slit in the footwear upper.

Clause 55. The method according to any one of Clauses 42 to 54, wherein the second upper component includes an elastic material.

Clause 56. The method according to any one of Clauses 42 to 55, wherein the slit is exposed at an exterior surface of the footwear upper in all configurations of the footwear upper.

Clause 57. The method according to any one of Clauses 42 to 56, wherein the footwear upper is free of separate components for closing the pocket.

Clause 58. The method according to any one of Clauses 42 to 57, wherein the pocket consists essentially of the first upper component and the second upper component bonded together to form an outer perimeter of the unfixed space.

Clause 59. The method according to any one of Clauses 42 to 57, further comprising:

forming a slit in a third upper component, the third upper component having a fifth surface and a sixth surface opposite the fifth surface; and arranging the third upper component such that the fifth surface directly faces at least one of the second surface or the fourth surface and such that the slit in the second upper component extends contiguously and/or overlappingly with the slit in the third upper component, and wherein the applying heat and/or pressure step further applies heat and/or pressure to the third upper component to engage the third upper component with at least one of the first upper component or the second upper component.

Clause 60. The method according to Clause 59, wherein the third upper component extends continuously at least from a third central rear heel location of the footwear upper to a third midfoot location of the footwear upper located forward of the unfixed space.

Clause 61. The method according to any one of Clauses 59 to 60, wherein the third upper component includes an elastic material.

Clause 62. The method according to any one of Clauses 42 to 61, further comprising: engaging a device release with the pocket.

Clause 63. The method according to Clause 62, wherein the device release is engaged with the third surface of the second upper component.

Clause 64. The method according to Clause 62, wherein the device release includes a strip of material having a first end engaged with the pocket, a second end opposite the first end, and a body portion extending from the first end to the second end; wherein the body portion extends through at least a portion of the unfixed space; and wherein the body portion has a sufficient length to extend through the slit such that the second end is positionable outside the pocket.

Clause 65. The method according to any one of Clauses 42 to 61, further comprising: placing an electronic module in the unfixed space of the pocket.

Clause 66. The method according to Clause 65, wherein the unfixed space of the pocket has a longitudinal dimension in a heel-to-toe direction of the footwear upper that is at least 1.25 times greater than a dimension of the electronic module extending in the heel-to-toe direction of the footwear upper when received in the pocket.

Clause 67. The method according to Clause 65 or 66, further comprising: engaging a device release with the pocket.

Clause 68. The method according to Clause 67, wherein the device release is engaged with the third surface of the second upper component.

Clause 69. The method according to Clause 67 or 68, wherein the device release includes a strip of material having a first end engaged with the pocket, a second end opposite the first end, and a body portion extending from the first end to the second end; wherein the body portion extends through at least a portion of the unfixed space; and wherein the body portion has a sufficient length to extend through the slit such that the second end is positionable outside the pocket.

Clause 70. The method according to Clause 69, wherein the electronic module is placed in the unfixed space such that: the body portion of the strip of material extends along a forward end of the electronic module, along at least one of an interior facing surface or an exterior facing surface of the electronic module, and beyond a rearward end of the electronic module to the second end of the strip of material.

Clause 71. The method according to Clause 69, wherein the electronic module is placed in the unfixed space such that: (i) the first end of the strip of material is engaged with the second upper component at a location adjacent a first surface of the electronic module, and (ii) the body portion of the strip of material extends along the first surface, around a forward end of the electronic module, along a second surface of the electronic module located opposite the first surface, and beyond a rearward end of the electronic module to the second end of the strip of material.

Clause 72. The method according to any one of Clauses 42 to 61, further comprising: engaging a stop member with at least one of the first upper component or the second upper component at a location proximate to the slit.

Clause 73. The method according to Clause 72, further comprising: placing an electronic module in the unfixed space of the pocket such that a rearward edge of the electronic module is located proximate to the stop member.

Clause 74. The method according to Clause 72, wherein the stop member includes a first raised ledge extending in a direction along at least a portion of the slit.

Clause 75. The method according to Clause 74, further comprising: placing an electronic module in the unfixed space of the pocket such that a rearward edge of the electronic module is located proximate to the first raised ledge of the stop member.

Clause 76. The method according to any one of Clauses 72 to 75, wherein the stop member is formed from a rigid plastic material.

Clause 77. The method according to any one of Clauses 42 to 76, wherein at least a portion of the second upper component is formed from an at least partially transparent or an at least partially translucent material.

Clause 78. The method according to any one of Clauses 42 to 77, wherein an exterior edge of the second upper component at the slit forms a retaining lip.

Clause 79. The method according to Clause 78, further comprising placing an electronic module in the unfixed space of the pocket such that a rearward end of the electronic module engages the retaining lip.

Clause 80. The method according to any one of Clauses 42 to 78, further comprising: placing a three-dimensional blank between the second surface and the third surface at a location of the pocket-forming arrangement, wherein the step of applying heat and/or pressure takes place with the three-dimensional blank located between the second surface and the third surface.

Clause 81. The method according to any one of Clauses 42 to 78, wherein the pocket-forming arrangement includes a three-dimensional blank placed between the second surface and the third surface.

Clause 82. The method according to Clause 81, wherein the three-dimensional blank is placed between the second surface and the third surface after the slit is formed in the second upper component.

Clause 83. The method according to Clause 81, wherein the three-dimensional blank is placed between the second surface and the third surface before the slit is formed in the second upper component.

Clause 84. The method according to any one of Clauses 42 or 44 to 83, wherein the slit is formed after the step of applying the heat and/or pressure.

Clause 85. A method of making an article of footwear, comprising: a method of forming a footwear upper according to any one of Clauses 42 to 84; and engaging the footwear upper with a sole structure.

What is claimed is:

1. An article of footwear, comprising:

an upper comprising:

(i) a first upper component having a first inward facing surface and a first outward facing surface, wherein the first upper component extends continuously at least from: (i) a location of the upper rearward of a parallel plane located at 0.05 L measured forward from a rearmost heel location of the article of footwear in a longitudinal direction of the article of footwear to (ii) a location of the upper forward of a parallel plane located at 0.4 L measured forward from the rearmost heel location in the longitudinal direction, and (ii) a second upper component having a second inward facing surface and a second outward facing surface, wherein a portion of the second inward facing surface is fixed with a portion of the first outward facing surface, and wherein the second upper component extends continuously at least from: (i) a location of the upper rearward of the parallel plane located at 0.05 L measured forward from the rearmost heel location in the longitudinal direction to (ii) a location of the upper forward of the parallel plane located at 0.4 L measured forward from the rearmost heel location in the longitudinal direction, wherein the first upper component and the second upper component define a pocket that includes: (a) the first outward facing surface, (b) the second inward facing surface, (c) a slit extending through the second upper component from the second outward facing surface to the second inward facing surface, and (d) an unfixed space between the first outward facing surface and the second inward facing surface where the second inward facing surface is unfixed with the first outward facing surface, wherein the slit provides access to the unfixed space; and a sole structure engaged with the upper.

2. The article of footwear according to claim 1, wherein an outer boundary of the unfixed space of the pocket is defined by an attached perimeter where the second inward facing surface is attached to the first outward facing surface, wherein 100% of the attached perimeter is formed in a sewn seam-free manner.

3. The article of footwear according to claim 1, wherein an outer boundary of the unfixed space of the pocket includes: (i) a top edge where the first outward facing surface is bonded to the second inward facing surface, (ii) a bottom edge where the first outward facing surface is bonded to the second inward facing surface, and (iii) a forward edge where the first outward facing surface is bonded to the second inward facing surface, wherein the forward edge extends between the top edge and the bottom edge, and wherein the forward edge is located on an opposite side of the pocket from the slit.

4. The article of footwear according to claim 3, wherein at least one of the top edge or the bottom edge extends downwardly from a location adjacent the slit to the forward edge.

5. The article of footwear according to claim 3, wherein when the article of footwear is supported on the sole structure on a horizontal support surface, at least one of the top edge or the bottom edge extends downwardly at an angle of 1 degree to 25 degrees with respect to a horizontal base line from a location adjacent the slit to the forward edge.

6. The article of footwear according to claim 3, wherein the top edge, the bottom edge, the forward edge, and the slit define a total interior pocket area within a range of 10 $cm^2$ to 25 $cm^2$.

7. The article of footwear according to claim 1, wherein when the article of footwear is supported on the sole structure on a horizontal support surface, the slit is oriented to extend in a substantially top-to-bottom direction of the upper at an angle of 75 degrees to 90 degrees with respect to a horizontal base line, and wherein a bottom end of the slit is located further rearward than a top end of the slit.

8. The article of footwear according to claim 1, wherein the slit is located at a lateral rear heel location of the upper and the unfixed space extends forward from the slit.

9. The article of footwear according to claim 1, wherein the second upper component includes an elastic material.

10. The article of footwear according to claim 1, further comprising:

an electronic module received in the unfixed space of the pocket.

11. The article of footwear according to claim 10, further comprising:

a device release engaged with the pocket, wherein the device release includes a strip of material having a first end engaged with the pocket, a second end opposite the first end, and a body portion extending from the first end to the second end; wherein the body portion extends through at least a portion of the unfixed space; and wherein the body portion has a sufficient length to extend through the slit such that the second end is positionable outside the pocket.

12. The article of footwear according to claim 11, wherein when the electronic module is received in the unfixed space, the body portion of the strip of material extends along a forward end of the electronic module, along at least one of an interior facing surface or an exterior facing surface of the electronic module, and beyond a rearward end of the electronic module to the second end of the strip of material.

13. The article of footwear according to claim 1, wherein an outer boundary of the unfixed space of the pocket includes: (i) a top edge where the first outward facing surface is bonded to the second inward facing surface, (ii) a bottom edge where the first outward facing surface is bonded to the second inward facing surface, and (iii) a forward edge where the first outward facing surface is bonded to the second inward facing surface, wherein the forward edge extends between the top edge and the bottom edge, wherein the forward edge is located on an opposite side of the pocket from the slit, wherein when the article of footwear is supported on the sole structure on a horizontal support surface: (i) at least one of the top edge or the bottom edge extends downwardly with respect to a horizontal base line from a location adjacent the slit to the forward edge, (ii) the top edge, the bottom edge, the forward edge, and the slit define a total interior pocket area within a range of 10 $cm^2$ to 25 $cm^2$, (iii) the slit is oriented to extend in a substantially top-to-bottom direction of the upper at an angle of 75 degrees to 90 degrees with respect to a horizontal base line, and (iv) a bottom end of the slit is located further rearward than a top end of the slit, and wherein an entire interior chamber of the pocket is located between parallel planes located at 0.05 L and 0.3 L measured forward from the rearmost heel location of the article of footwear in a longitudinal direction of the article of footwear.

14. The article of footwear according to claim 1, further comprising:

an electronic module received in the unfixed space of the pocket, wherein the electronic module within the pocket stretches an elastic material of the second upper component to thereby hold the electronic module in place within the pocket due to force applied to the electronic module by resilience of the second upper component.

15. The article of footwear according to claim 1, wherein the second upper component: (a) extends rearward beyond the unfixed space of the pocket by a distance of at least 25 mm and (b) extends forward beyond the unfixed space of the pocket by a distance of at least 25 mm.

16. The article of footwear according to claim 1, wherein the second upper component: (a) extends rearward beyond the unfixed space of the pocket by a distance of at least 25 mm and (b) extends forward beyond the unfixed space of the pocket by a distance of at least 40 mm.

17. An article of footwear, comprising:

an upper comprising:

(i) a first upper component having a first inward facing surface and a first outward facing surface, (ii) a second upper component having a second inward facing surface and a second outward facing surface, wherein a portion of the second inward facing surface is fixed with a portion of the first outward facing surface, and (iii) a third upper component having a third inward facing surface and a third outward facing surface, wherein at least a portion of the third inward facing surface is fixed with at least one of the first outward facing surface or the second outward facing surface, wherein the first upper component and the second upper component define a pocket that includes: (a) the first outward facing surface, (b) the second inward facing surface, (c) a slit extending through the second upper component from the second outward facing surface to the second inward facing surface, and (d) an unfixed space between the first outward facing surface and the second inward facing surface where the second inward facing surface is unfixed with the first outward facing surface, wherein the slit provides access to the unfixed space, and wherein a portion of the slit extends through the third upper component from the third outward facing surface to the third inward facing surface; and a sole structure engaged with the upper.

18. The article of footwear according to claim 17, wherein the first upper component extends continuously at least from a first central rear heel location of the upper to a first midfoot location of the upper located forward of the unfixed space, and wherein the second upper component extends continuously at least from a second central rear heel location of the upper to a second midfoot location of the upper located forward of the unfixed space.

19. The article of footwear according to claim 17, wherein the second upper component extends continuously at least from: (i) a central rear heel location of the upper rearward of a parallel plane located at 0.05 L measured forward from a rearmost heel location of the article of footwear in a longitudinal direction of the article of footwear to (ii) a midfoot location of the upper forward of a parallel plane located at 0.4 L measured forward from the rearmost heel location of the article of footwear in the longitudinal direction of the article of footwear.

20. The article of footwear according to claim 17, wherein the second upper component extends continuously at least from: (i) a central rear heel location of the upper rearward of a parallel plane located at 0.05 L measured forward from a rearmost heel location of the article of footwear in a longitudinal direction of the article of footwear to (ii) a midfoot location of the upper forward of a parallel plane located at 0.6 L measured forward from the rearmost heel location of the article of footwear in the longitudinal direction of the article of footwear.

* * * * *